US006903924B1

(12) United States Patent
Tyner

(10) Patent No.: US 6,903,924 B1
(45) Date of Patent: Jun. 7, 2005

(54) COMPUTER KEYBOARD TRAY

(76) Inventor: Jeff D. Tyner, 2879 Canyonside Ct. NE., Grand Rapids, MI (US) 49525

( * ) Notice: Subject to any disclaimer, the term of this patent is extended or adjusted under 35 U.S.C. 154(b) by 89 days.

(21) Appl. No.: 10/205,059

(22) Filed: Jul. 25, 2002

Related U.S. Application Data

(63) Continuation-in-part of application No. 09/738,567, filed on Dec. 15, 2001, now Pat. No. 6,644,605.
(60) Provisional application No. 60/172,498, filed on Dec. 17, 1999.

(51) Int. Cl.[7] ..... G06F 1/16
(52) U.S. Cl. ..... 361/680; 361/683; 206/701; 211/41.17; 220/543; 248/560
(58) Field of Search ..... 361/680, 683–686, 361/679, 681; 206/701, 706; 211/1.3, 41.17, 85.17, 86.01; 220/4.02, 543, 555, 559; 248/560, 118, 274.1, 298.1, 681, 682, 918, 919; 108/1, 6, 8, 10, 26, 42, 50, 50.2, 93, 134, 147.11; 312/223.1–223.3, 208.1–208.3, 283; D14/331

(56) References Cited

U.S. PATENT DOCUMENTS

| | | | | | |
|---|---|---|---|---|---|
| 2,953,131 | A | | 9/1960 | Bird | 128/215 |
| D275,755 | S | | 10/1984 | Cottrill et al. | D14/100 |
| D288,097 | S | | 2/1987 | Harter et al. | D14/114 |
| 4,709,972 | A | * | 12/1987 | LaBudde et al. | 312/208.3 |
| 4,776,284 | A | | 10/1988 | McIntosh | 108/138 |
| 4,931,978 | A | * | 6/1990 | Drake et al. | 361/680 |
| 5,125,606 | A | | 6/1992 | Cassano et al. | 248/118 |
| 5,131,614 | A | | 7/1992 | Garcia et al. | 248/118 |
| D331,045 | S | | 11/1992 | Moerke | D14/114 |
| 5,197,699 | A | | 3/1993 | Smith et al. | 248/118 |
| 5,358,203 | A | | 10/1994 | Smith et al. | 248/118 |
| 5,374,018 | A | | 12/1994 | Daneshvar | 248/118 |
| 5,375,800 | A | | 12/1994 | Wilcox et al. | 248/118.1 |
| 5,383,632 | A | | 1/1995 | Shirlin et al. | 248/118.5 |
| 5,385,322 | A | * | 1/1995 | Kim et al. | 248/118 |
| D357,910 | S | | 5/1995 | Newhouse | D14/114 |
| D361,992 | S | | 9/1995 | Evenson et al. | D14/114 |
| 5,451,020 | A | | 9/1995 | Smith et al. | 248/118 |
| 5,464,292 | A | | 11/1995 | Grant | 400/715 |
| 5,490,647 | A | | 2/1996 | Rice | 248/118.1 |
| 5,492,298 | A | | 2/1996 | Walker | 248/346.01 |
| 5,502,616 | A | | 3/1996 | Maguire, Jr. | 361/681 |
| 5,533,697 | A | | 7/1996 | Fletcher et al. | 248/146 |
| 5,542,637 | A | | 8/1996 | Schriner | 248/346.01 |
| 5,562,270 | A | | 10/1996 | Montague | 248/118.1 |
| D376,791 | S | | 12/1996 | Schreiner | D14/114 |
| D377,169 | S | | 1/1997 | Chida | D14/114 |
| 5,593,128 | A | | 1/1997 | Odom et al. | 248/346.01 |
| 5,692,815 | A | | 12/1997 | Murphy | 312/283 |
| 5,713,544 | A | | 2/1998 | Wolf et al. | 248/118 |
| D392,958 | S | | 3/1998 | Gaete | D14/114 |
| 5,732,910 | A | | 3/1998 | Martin | 248/118 |
| 5,825,612 | A | | 10/1998 | Aubuchon et al. | 361/680 |
| D403,312 | S | | 12/1998 | O'Brien et al. | D14/114 |
| 5,878,674 | A | | 3/1999 | Allan | 108/93 |
| 5,893,540 | A | | 4/1999 | Scott | 248/118 |
| 5,927,662 | A | * | 7/1999 | West et al. | 248/118 |
| 5,931,103 | A | | 8/1999 | Huang | 108/50.02 |
| 6,045,098 | A | | 4/2000 | Timm | 248/118 |
| 6,079,676 | A | | 6/2000 | Hackett et al. | 248/118 |

(Continued)

*Primary Examiner*—Yean-Hsi Chang
(74) *Attorney, Agent, or Firm*—Van Dyke, Gardner, Linn & Burkhart, LLP

(57) ABSTRACT

A computer keyboard tray includes a tray body formed from a compressible material and a support member, which provides reinforcement to the tray body. Optionally, the keyboard tray may incorporate an attachment assembly, allowing the keyboard tray to be removably attached to a computer keyboard support mechanism. Preferably, the keyboard tray includes a wrist rest which is monolithically formed with the tray body. In an alternative preferred embodiment, an adjustable wrist rest assembly is attached to the tray.

26 Claims, 13 Drawing Sheets

U.S. PATENT DOCUMENTS 6,092,774 A 7/2000 Choy ..... 248/298.1
6,158,359 A 12/2000 Allan et al. ..... 108/93
6,158,829 A 12/2000 Nielsen ..... 312/208.1
6,179,261 B1 1/2001 Lin ..... 248/274.4
6,305,652 B1 * 10/2001 Borke et al. ..... 248/174
6,353,530 B1 * 3/2002 Zarek et al. ..... 361/683
6,409,127 B1 6/2002 VanderHeide et al. ..... 248/118
6,498,719 B1 * 12/2002 Bridges ..... 361/680

* cited by examiner

COMPUTER KEYBOARD TRAY

CROSS REFERENCE TO RELATED APPLICATION

This application is a continuation-in-part application of application Ser. No. 09/738,567, filed Dec. 15, 2001, now U.S. Pat. No. 6,644,605 which claims priority from U.S. Provisional Pat. Application Ser. No. 60/172,498, filed Dec. 17, 1999, the entire disclosure of which is hereby incorporated herein by reference.

BACKGROUND OF THE INVENTION

The present invention relates generally to devices for use in conjunction with a computer, and more particularly, to a polymeric computer keyboard tray and method for making the same.

The use of computers in both business and the home is commonplace and routine. Our reliance upon personal computers continues to increase. A large number of individuals spend a majority of their day operating a personal computer. These individuals, as well as those having a pre-existing muscular or skeletal infirmity, are prone to the development of repetitive stress injuries. Repetitive stress injuries are most often attributed to the lack of a proper ergonomic position while entering data into a computer and specifically, to the position of one's arms and hands when typing on the keyboard. There are a wide variety of repetitive stress injuries, most of which affect an individual's wrists, hands, and forearms. If a person's typing position is not corrected, these repetitive stress injuries can eventually cause muscle fatigue, swelling of the joints and tendons, and may lead to serious nerve damage. The most prevalent form of repetitive stress injury is Carpal Tunnel Syndrome, caused by compression of certain nerves in the wrist and leading to a loss of sensation in the fingers and the hands. Left untreated, Carpal Tunnel Syndrome may require surgery, and often requires medical attention resulting in discomfort and the loss of work time.

In response to repetitive stress injuries, the industry has advanced a variety of computer keyboard trays and wrist rests intended to support the keyboard and elevate the wrists of an individual to a proper ergonomic typing position. Many existing computer keyboard trays are formed of several independent layers, adhered to one another in order to form the keyboard tray. The use of several discrete layers in the formation of a keyboard tray increases the cost and complexity of the manufacturing process. Furthermore, over time, the layers of these keyboard trays have a tendency to shift or separate. This shifting or sliding causes the computer keyboard to move when one is typing, thereby complicating the process of using the computer.

An additional problem confronted by the computer industry is the use of computer keyboard trays in conjunction with computer keyboard support mechanisms. Computer keyboard support mechanisms are normally mounted on the underside of a work surface, for example a desk or table, such that it may be moved between a retracted position, where it is positioned under the work surface, and an extended position, wherein it is extended beyond the front edge of the work surface. In addition, many of these computer keyboard support mechanisms include a tilting feature, allowing the angle of the computer keyboard to be adjusted so as to enable an individual to alter the angle, or tilt, of the computer keyboard in order to achieve a comfortable typing position. Keyboard trays used in conjunction with computer keyboard support mechanisms are normally a flat sheet made of a rigid material having a perimeter composed of hard angles or surfaces. Inadvertent contact with these hard surfaces may cause injury to individuals and/or damage to equipment. Additionally, many of the keyboard trays used in conjunction with computer keyboard support mechanisms do not contain a wrist rest and thereby increase the probability that an individual using such computer keyboard support mechanism will incur some form of repetitive stress injury.

Therefore, there exists a need for a keyboard support tray which is economical to manufacture, rigid, and yet provides an ergonomically correct, cushioned surface for support of one's wrists while typing.

SUMMARY OF THE INVENTION

According to one aspect of the invention, a keyboard tray for use with a computer keyboard includes a tray body, that is formed from a compressible material and has a generally planar upper surface dimensioned for supporting a computer keyboard thereon. A support member, which comprises a substantially rigid material, is positioned at least partially within the body to provide reinforcement to at least a portion of the tray body.

In one aspect, the tray body includes a wrist rest, which are both preferably formed from the compressible material and, preferably, with the body and the wrist rest being monolithic.

In a further aspect, the support member is integrally molded in the tray body. Further, the support member includes a lower surface, which is substantially flush with the lower surface of the tray body.

In another aspect, the tray body includes a recess with the support member positioned in the recess.

According to yet another aspect, the tray includes a pair of arcuate channels, with alternately each channel dimensioned to receive a thigh of an operator. The tray includes a contoured lower surface configured to incline the upper planar surface when the lower surface is supported on a generally horizontal surface.

In another form of the invention, a keyboard tray for use with a computer keyboard and a computer keyboard support mechanism includes a tray body having an upper planar surface and an enlarged portion forming a wrist rest. The upper planar surface is dimensioned for supporting a keyboard. The tray body comprises a compressible material and includes a support member, which comprises a substantially rigid web that reinforces the tray body wherein the tray body is capable of supporting a keyboard. An attachment assembly is carried by the tray body and configured to removably mount the tray body to a computer keyboard support mechanism.

In one aspect, the attachment assembly is preferably mounted to the support member.

In yet another form of the invention, a method of making a keyboard tray includes providing a substantially rigid support member, applying a cushioning material to the support member, and forming a wrist rest with the cushioning material. For example, the cushioning material may be applied by spraying, dipping, or coating. In one aspect, the cushioning material is applied by molding. For example, the support member may be placed in a mold cavity of an injection molding apparatus, with the cushioning material injected in the mold cavity to at least partially encapsulate the support member.

It can be appreciated from the foregoing that the present invention provides an ergonomically pleasing keyboard tray that is easy to use and, further, that is comfortable to the user. These and other advantages and features of the present invention will be apparent to one skilled in the art, in light of the following specification when read in conjunction with the accompanying drawings.

DETAILED DESCRIPTION OF THE PREFERRED EMBODIMENTS

Figure 1:
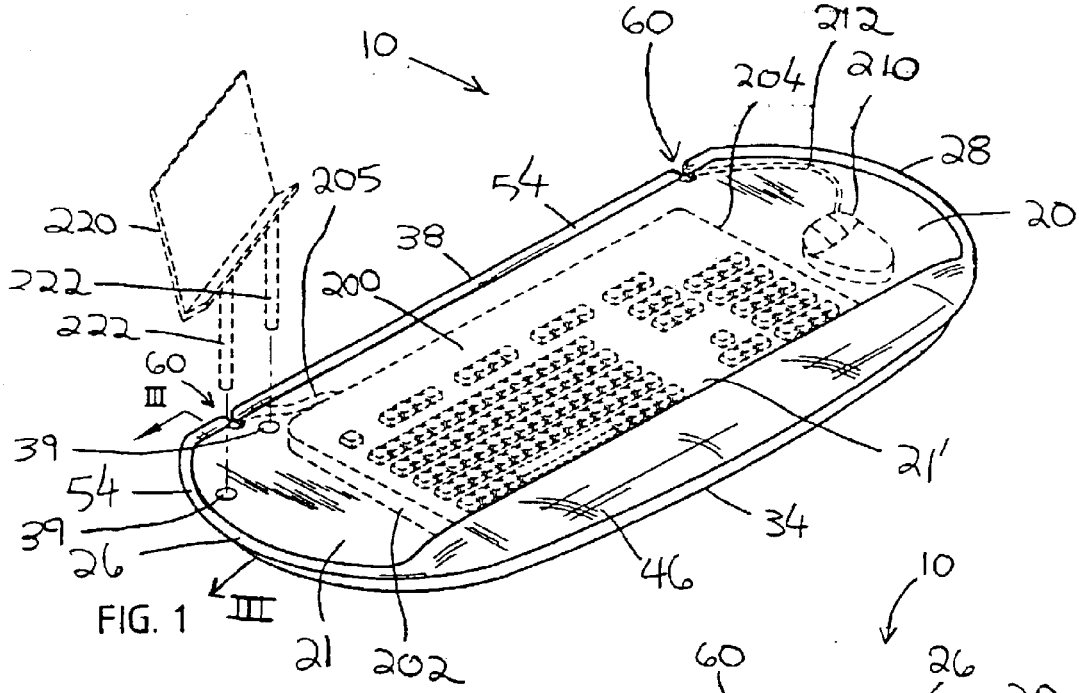
FIG. 1 is a perspective view of a keyboard tray according to the invention, with a computer keyboard, mouse and accessory device illustrated in phantom.

The present invention provides a keyboard tray and method for making the same, formed of a single polymeric material, and including a support member integrally molded within the interior of the keyboard tray. The support member of the present invention provides adequate rigidity and prevents the keyboard tray from flexing, enabling the keyboard tray to be used in conjunction with computer keyboard support mechanisms commonly used in both business and home environments. The keyboard tray of the present invention is economical to manufacture, and results in an aesthetically attractive device having sufficient cushioning to provide a comfortable typing surface and minimize the probability of contracting a repetitive stress injury.

Referring now to the FIG. 1 through 10, a computer keyboard tray 10, according to the present invention, includes a keyboard receiving member 20 having a top 21, a pair of opposing sides 26 and 28, a front 34, and a back 38. Sides 26 and 28, and front 34 are curved outwardly, with sides 26, and 28 preferably having a greater angle of curvature than front 34. Alternatively, sides 26, 28 and front 34 are linear. Top 21 is a generally planar surface.

Figure 14:
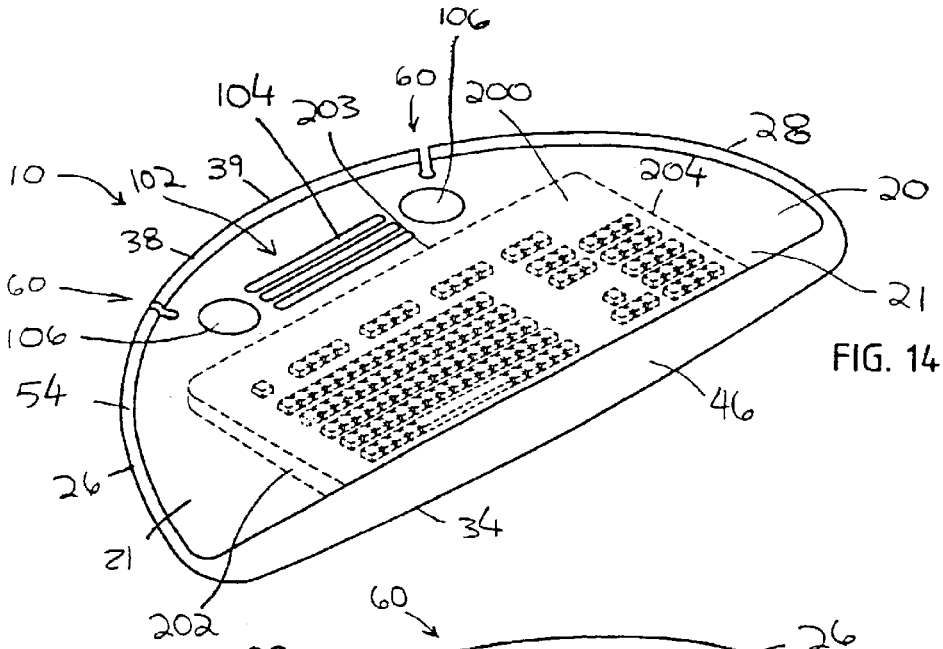
FIG. 14 is a perspective view of a keyboard tray according to still another alternative preferred embodiment, with the computer keyboard illustrated in phantom.

In another preferred form, as shown in FIG. 14, sides 26, and 28, and back 38 define a generally half circle shape. Also, preferably, sides 26, 28 and back 38 are curved or tapered inwardly towards bottom 30, as shown most clearly in FIG. 3. The inwardly curved surfaces from top 21 to bottom 30 of sides 26, 28 and back 38 provide a sleek, aesthetic appearance. Extending from front region 21' of top 21 is a wrist rest 46. In one preferred embodiment, wrist rest 46 and keyboard receiving member 20 are monolithic, i.e., unitary in construction, and formed of a foamed polymeric material. Any polymeric material having sufficient durability, and density may be used. Preferably, the polymeric material used in the manufacture of keyboard tray 10 is foamed polyurethane. Integrally molded within interior 25 of keyboard receiving member 20 is a support member 70.

The length of keyboard tray 10, defined as the distance between sides 26 and 28, in one preferred form, is long enough to support a standard, or extended size, computer keyboard 200 thereupon with sufficient distance remaining from edge 202 or 204 of computer keyboard 200 and sides 26 or 28 of keyboard receiving member 20, respectively, to thereby permit the placement and operation of a computer peripheral device, such as for example, a mouse 210. As can be seen in FIG. 1, the length of keyboard tray 10 is sufficient to enable the user to place mouse 210 adjacent side 26, or side 28 depending upon the computer operators preference.

Wrist rest 46, extending above the plane defined by top 21 of keyboard receiving member 20, is sized to extend substantially the length of keyboard tray 10, and terminate proximate to sides 26 and 28. The length of wrist rest 46 allows a computer operator to support their wrists upon wrist rest 46 while entering data into computer keyboard 200, and while operating mouse 210. Wrist rest 46 may be formed having any height and width desired, so as to provide an ergonomically correct support for one's wrists. As depicted most clearly in FIGS. 4 and 8, wrist rest 46 preferably has a outwardly curved top surface 48. Curved top surface 48 creates a comfortable support upon which an operator's wrists are placed. Wrist rest 46 is formed having a substantially vertical inner surface 50, abutting edge 203 of computer keyboard 200, or positioned in proximity thereto. Vertical inner surface 50 of wrist rest 46 provides a barrier, or straight surface, against which computer keyboard 200 may be properly positioned. In addition, vertical inner surface 50 prevents keyboard 200 and/or mouse 210 from being inadvertently removed from top 21 of keyboard receiving member 20 during operation and prevents computer keyboard 200 from sliding when placed at an angle. The density of wrist rest 46 may be either less than or substantially equal to the density of keyboard receiving member 20. Wrist rest 46 is preferably slightly compressible so that upon placement of one's wrists upon outer surface 48, wrist rest 46 deforms slightly, but maintains the proper ergonomic wrist position. Upon removal of one's wrists, wrist rest 46 returns to its normal, non-compressed position. Wrist rest 46 may be solid in construction, or may have an internal channel as will be discussed below.

A rim 54 projects upwardly, beyond the horizontal plane defined by top 21, from opposing sides 26, 28 and back 38 of keyboard receiving member 20. Rim 54 has an arcuate outer surface and also provides a barrier, preventing mouse 210 from falling off top 21 of keyboard receiving member 20 during operation, and especially when keyboard tray 10 is placed at an angle.

At least one cable way 60 is formed in keyboard receiving member 20. Cable way 60 is positioned along back 38 and proximate to a side 26, or 28. Preferably, there are two cable ways 60, each of which is proximate to a side 26, or 28, with one removably accepting the electrical cable 212 of mouse 210, and the other, electrical cable 205 of computer keyboard 200. Removably securing electrical cable 212 of mouse 210 to keyboard tray 10 facilitates the orientation of mouse 210 and manages the length of electrical cable 212 so as to permit optimal movement of mouse 210 upon keyboard receiving member 20. Furthermore, cable ways 60 prevent mouse 210, and computer keyboard 200, from being inadvertently detached from keyboard tray 10 in the event contact is made with electrical cable 205 and/or 212.

Figure 6:
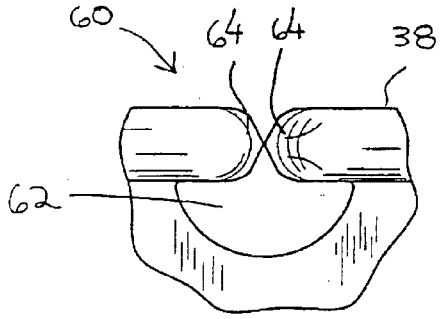
FIG. 6 is a detailed plan view depicting the cable way of the present invention.

With reference to FIG. 6, in one preferred form, cable ways 60 each include a vertical cutout section 62 formed in back 38 of keyboard receiving member 20, and a pair of inwardly tapered flanges 64 which together enclose cutout section 62. To insert electrical cable 205 or 212 within cutout section 62 of a cable way 60, a slight force is used to urge electrical cable 205 or 212 beyond flanges 64 and seat the cable within cutout section 62. Flanges 64 provide resistance to the removal of electrical cable 205 or 212 from cutout section 62 in the event inadvertent contact is made with electrical cable 205 or 212.

Figure 7:
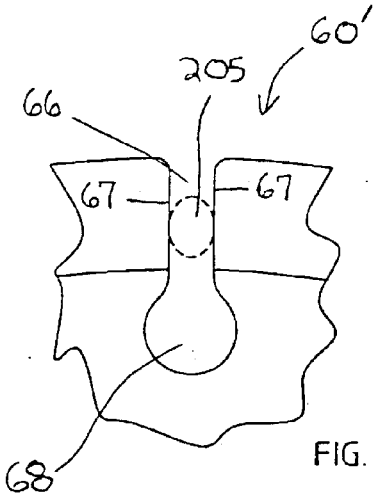
FIG. 7 is a detailed, plan view depicting a cable way according to an alternative preferred embodiment.

In an alternative preferred form, as shown in FIG. 7, each cable way 60' has a generally keyhole slot shape with a generally linear slot 66, and a circular seating section 68. The walls 67 defining slot 66 are positioned a preselected distance apart, such that there is frictional engagement between walls 67 and electrical cable 205 or 212, while seating section 68 is preferably circular and has a wider area relative to slot 66. Thus, when one inserts electrical cable 205 or 212 through cable way 60', frictional resistance is experienced as electrical cable 205 or 212 is urged through slot 66, and is forwarded to seating section 68. Further, this frictional resistance acts as a barrier, preventing the inadvertent removal of electrical cable 205 or 212 from cable way 60'.

Positioned proximate to side 26 and back 38 are a pair of throughholes 39 which together define an accessory support assembly. Throughholes 39 are dimensioned to removably receive support posts 222 of a computer accessory device 220. As depicted in FIG. 1, computer accessory device 220 is illustrated as a document stand configured to support a document in a substantially vertical position, and hence, allows a computer operator to read therefrom in a facile manner. Although the accessory support assembly is described as supporting a document stand, it will be recognized by those with ordinary skill in the art that the accessory support assembly may be used to support other computer accessories without departing from the spirit and scope of the present invention.

Figure 9:
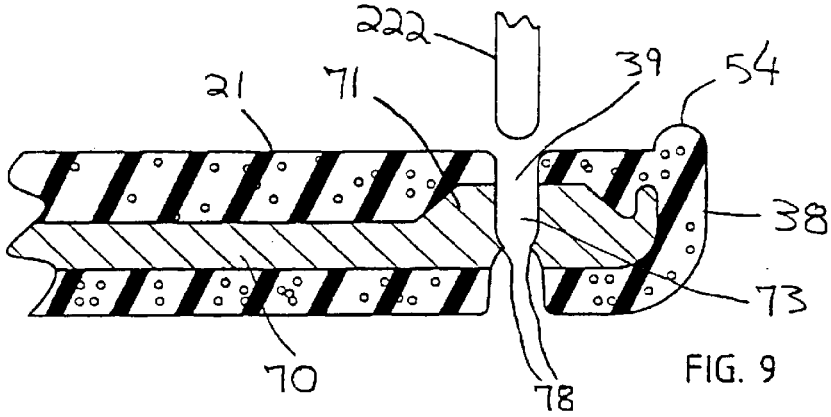
FIG. 9 is a sectional view depicting the raised section of the support member.

As shown in FIG. 9, support member 70 may be formed with a pair of regions 71, each of which surrounds throughhole 39 in keyboard receiving member 20, and is formed having a greater height than the remainder of support member 70. Each region 71 also includes a throughhole 73 in registry with throughhole 39. Furthermore, a pair of inwardly extending lips 78, formed within support member 70 extend within throughholes 73. Lips 78 of support member 70 provide a frictional barrier which must be overcome during insertion and removal of support posts 222 from throughholes 39 and 73. Overcoming this slight frictional force aids in the securement of support post 222 within keyboard tray 10. Additionally, the increased height of regions 71 of support member 70 provides additional resistance to horizontal forces, and thereby securely supports accessory device 220 in keyboard tray 10.

Figure 8:
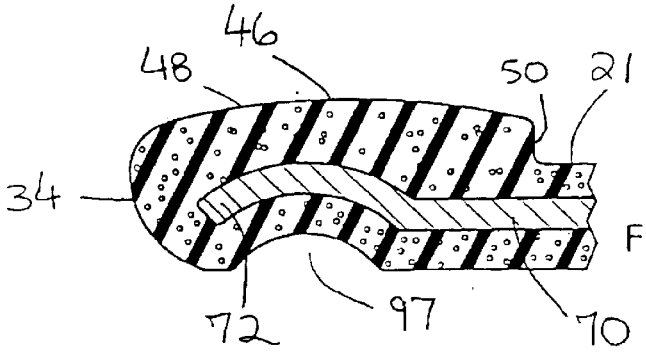
FIG. 8 is a cross-sectional view depicting a curved support member according to an alternative preferred embodiment.

Support member 70 is generally rigid, and integrally formed within the interior 25 of keyboard tray 10 during the molding process, as will be discussed below. Preferably, support member 70 is substantially linear and has a length less than the distance between sides 26 and 28, and a width less than the distance between back 38 and front 34 so that the perimeter of keyboard receiving member 20 and at least a portion of wrist rest 46 are not supported by support member 70. That is, sides 26, 28, back 38, and wrist rest 46 are cantilevered from support member 70. The dimensions of support member 70 enables sides 26, 28, and back 38 to be slightly softer and more flexible than the remainder of keyboard tray 10 and provides a greater cushioning effect in the event contact is made between keyboard tray 10 and an individual or surrounding equipment. The absence of support member 70 within at least a portion of wrist rest 46 permits wrist rest 46 to flex slightly about a horizontal plane when one's wrists are placed thereupon, permitting a more comfortable typing position. Moreover, the dimensions of support member 70 result in a lighter keyboard tray 10, without sacrificing necessary strength and rigidity. Alternatively, as shown in FIG. 8, support member 70 may have a width sufficient to support wrist rest 46, and is provided with a curved section 72 proximate to front 34 to increase the rigidity of wrist rest 46. Support member 70 is preferably positioned with interior 25 of keyboard receiving member 20 such that it is approximately the same distance from top 21 and bottom 30.

Support member 70 may be any material commonly utilized in the art capable of providing sufficient rigidity to keyboard tray 10. Non-limiting examples of materials suitable for use as support member 70 include metals, metal alloys, wood or wood composites, and polymeric materials. Preferably, support member 70 is formed of polyurethane. Most preferably, support member 70 is a composite wood board.

Figure 5:
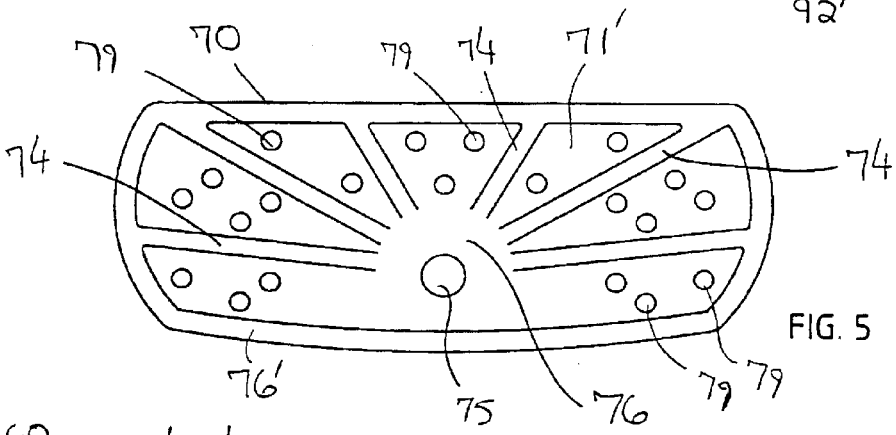
FIG. 5 is a plan view of a support member according to the invention.

As shown in FIG. 5, in one preferred form, support member 70 is formed having a plurality of ribs 74 extending from top surface 71'. Ribs 74 extend in a radial pattern from the central region 76 of support member 70, and impart additional rigidity upon support member 70, preventing flexing of support member 70, and thus increases the strength of keyboard tray 10. Additionally, a rim 76' extends from the perimeter of support member 70 to further increase rigidity. It will be recognized by those with ordinary skill in the art that although only top surface 71' is shown having ribs 74 and rim 76', it is within the spirit and scope of the present invention to include ribs 74 and rim 76' on the bottom surface of support member 70. Furthermore, it will be understood that alternate rib patterns may be substituted for the radial pattern depicted in FIG. 5, without departing from the spirit and scope of the invention.

Figure 2:
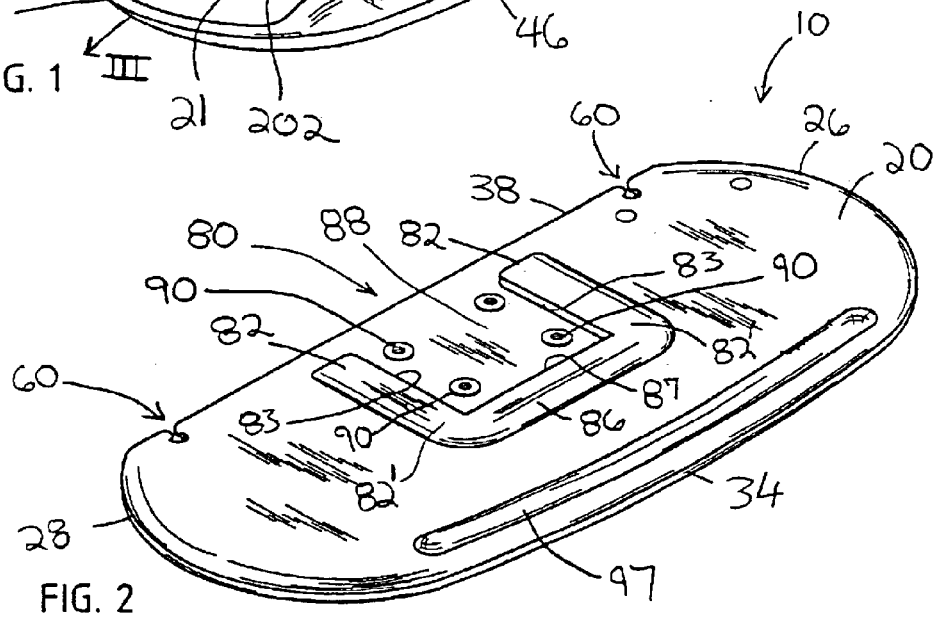
FIG. 2 is a bottom perspective view of the keyboard tray depicted in FIG. 1.
Figure 3:
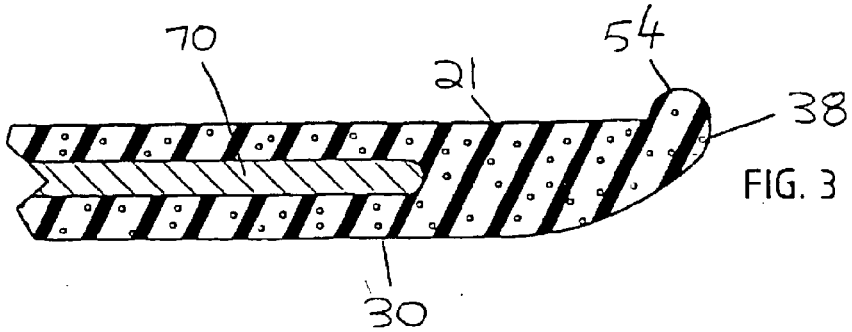
FIG. 3 is a sectional view taken along lines III—III of FIG. 1.
Figure 4:
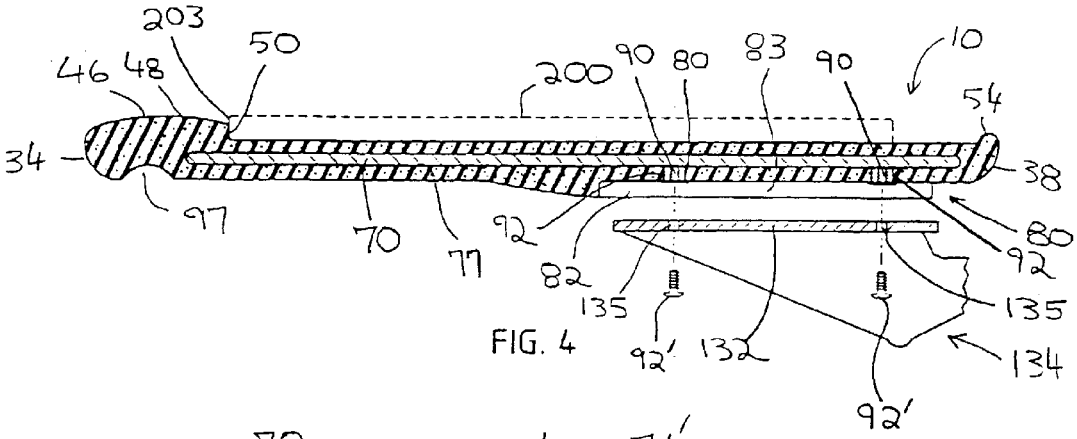
FIG. 4 is an exploded, cross-sectional view of the keyboard tray of FIGS. 1 and 2, depicting attachment to a computer keyboard support mechanism with the computer keyboard depicted in phantom.

Bottom 30 of keyboard receiving member 20 includes an attachment assembly 80 depending therefrom (FIG. 2). Attachment assembly 80 includes a pair of spaced side members 82 extending in a direction substantially perpendicular to back 38, and terminating proximate to back 38. Ends 82' of side members 82 are joined by a bridge member 86 running generally perpendicular to side members 82. Side members 82 and bridge member 86 collectively define a contact surface 88 in bottom surface 30 of keyboard receiving member 20. Contact surface 88 is sized to abuttingly contact a platform 132 of a conventional computer keyboard support mechanism 134 (FIG. 4), normally movably attached to the underside of a work surface (not shown). Furthermore, inner surfaces 83 of side members 82 and inner surface 87 of bridge member 86 define a wall to prohibit movement of platform 132 of computer keyboard support mechanism 134 from contact surface 88. Attachment assembly 80 further includes at least one, and preferably four, fastener receiving members 90 positioned in throughholes 92 formed in contact surface 88. Fastener receiving members 90 are fixedly attached to bottom surface 77 of support member 70, by any mechanical means or adhesive commonly utilized in the industry. Fastener receiving members 90 may be any receiving members commonly utilized in the art dimensioned to securingly receive fasteners 92' positioned through apertures 135 of platform 132. For example purposes only, fastener receiving members 90 may be circular bosses having a threaded channel, while fasteners 92' are bolts dimensioned for receipt by the circular bosses.

Figure 15:
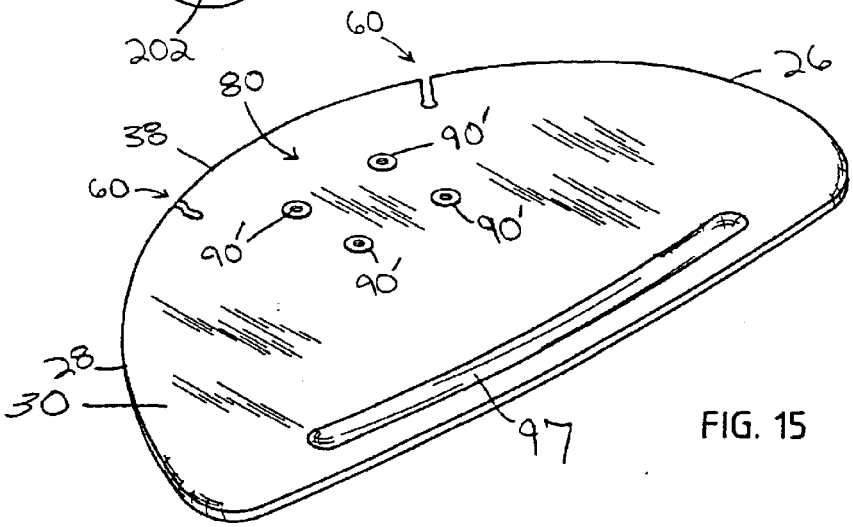
FIG. 15 is a bottom perspective view of the keyboard tray of FIG. 14.

Alternatively, a shown in FIG. 15, an attachment assembly 80' includes one or more fastener receiving members 90' fixedly attached to support member 70 and extending through keyboard receiving member 20 via throughholes 92. Fastener receiving members 90' are of the same construction as fastener receiving members 90, and are fixedly attached to bottom surface 77.

To secure keyboard tray 10 to computer keyboard support mechanism 134, keyboard tray 10 is first placed upon platform 132 such that platform 132 abuttingly contacts bottom surface 30 of keyboard receiving member 20. Thereafter, fasteners 92' are placed through apertures 135 and secured within fastener receiving members 90 or 90' to thereby anchor keyboard tray 10 to platform 132 of computer keyboard support mechanism 134.

As shown in FIGS. 2, 4, 8, and 15, bottom 30 of keyboard receiving member 20 includes a channel 97 proximate to front 34 and extending substantially the length between sides 26, 28. Channel 97 may be generally linear or express an angle of curvature approximately equal to the angle of curvature of front 34. Channel 97 provides a grasping surface, permitting an operator to move the keyboard tray 10 and computer keyboard mechanism 134 between an extended and a retracted position.

Figure 16:
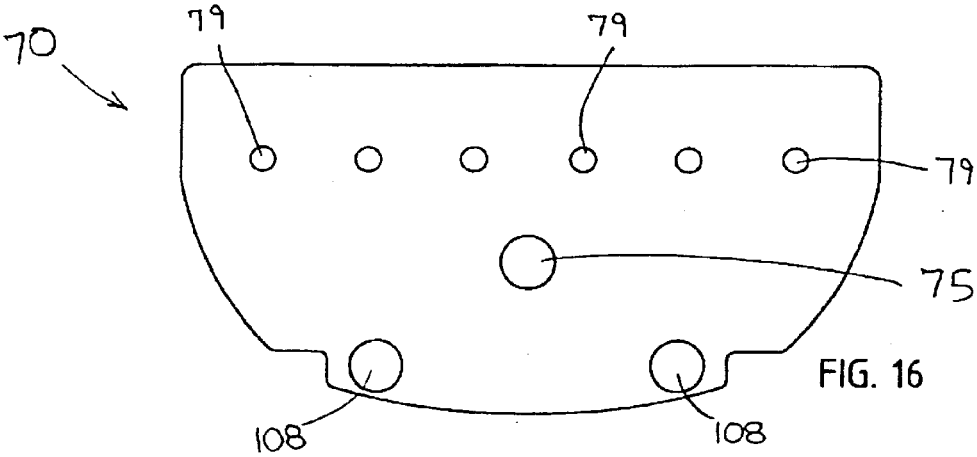
FIG. 16 is a plan view of the support member for the keyboard tray of FIGS. 14 and 15.
Figure 17:
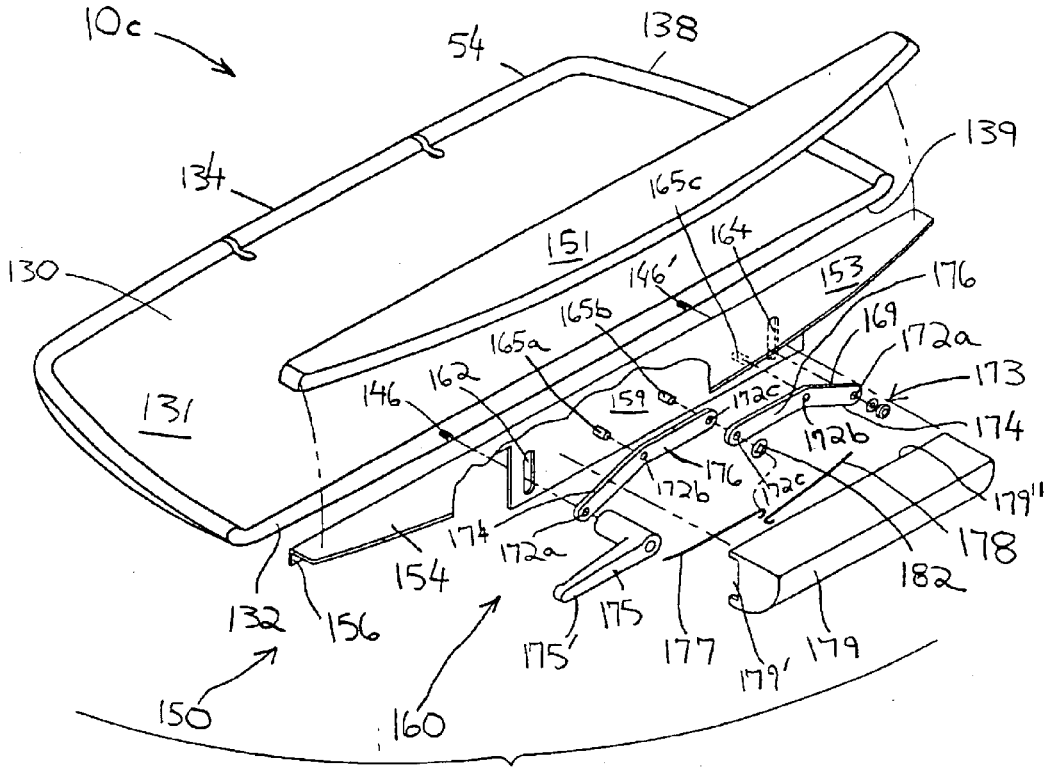
FIG. 17 is an exploded perspective view of a keyboard tray according to still another alternative preferred embodiment.

In one preferred form, as shown in FIG. 14, keyboard receiving member 20 of keyboard 10 is sized such that the distance between the apex 39 of back 38 and vertical inner surface 50 of wrist rest 46 is sufficient to enable the placement of a standard, or extended size, computer keyboard 200, with sufficient distance remaining from edge 203 of computer keyboard 200 and apex 39 of back 38 such that a region 102 is formed therebetween. Region 102 of keyboard receiving member 20 is formed with one or more channels 104 spanning generally parallel to wrist rest 46, and dimensioned to receive pens, pencils, erasers, and the like. In addition, region 102 is formed with on or more depressions or indentations 106. Indentations 106 are preferably circularly shaped, and are sized to permit the placement of paper clips, binder clips and the like therein. Preferably, as shown in FIG. 16, support member 70 is formed having holes 108 which correspond to indentations 106 during the molding process to provide greater depth to indentations 106 and a softer surface. Also shown in FIG. 16, are cutout regions 109 which correspond to the molding regions of cable ways 60, 60'.

Figure 10:
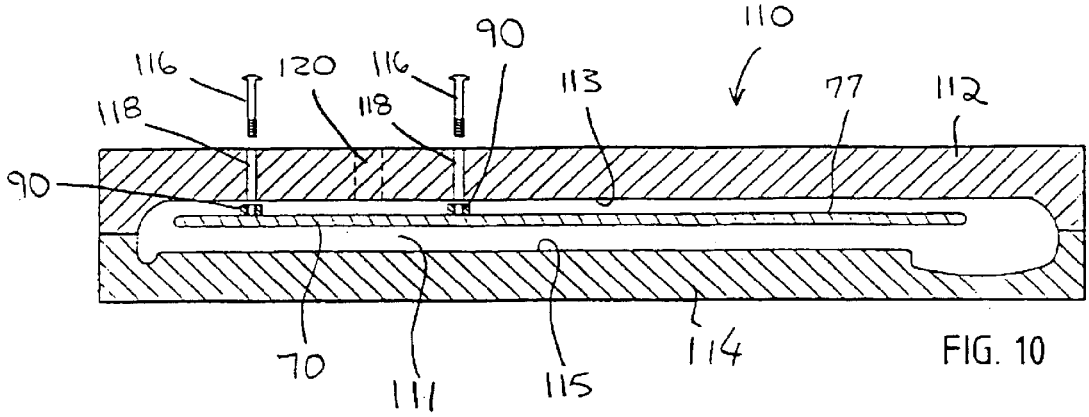
FIG. 10 is a sectional view depicting an injection mold and the support member of the keyboard tray.

Turning now to FIG. 10, there is shown an injection mold 110 having sections 112 and 114. To form keyboard tray 10, injection mold 110 is oriented so that section 114, having inner surface 115, corresponding to the top 21 of keyboard receiving member 20 and the exterior surface of wrist rest 46, positioned below section 112. Support member 70 is then heated to a pre-selected temperature prior to introduction within injection mold 110. Pre-heating support member 70 before injecting polymeric material within injection mold 110 improves the material flow characteristics of the polymer contacting support member 70, resulting in a keyboard tray having a uniform density and increasing the bond between the polymer and support member 70. A suitable release agent is then applied to interior surface 113, 115 of sections 112, 114, respectively. The release agent utilized can be any release agent normally utilized in the art, and is preferably paraffin based. Thereafter, the interior surface of injection mold 110 is optionally coated with an in-mold paint coat to vary the surface color of keyboard tray 10. Once the optional in-mold paint coat is in place within injection mold 10, support member 70 is placed within the interior 111 of injection mold 110, and held therein at a preselected distance from both inner surface 113 of section 112 and inner surface 115 of section 114 by fasteners 116, such as, for example, bolts. Fasteners 116 are threaded through section 112 of injection mold 110, via holes 118, and secured to fastener receiving members 90 attached to bottom surface 77 of support member 70. Once support member 70 is secured within interior 111 of injection mold 110, the mold is sealed and the polymeric material utilized to form keyboard tray 10 is injected within interior 111 through an injection port 120. Once an adequate charge of polymeric material is injected within injection mold 110, it is subjected to a preselected temperature and pressure schedule in order to produce a foamed polymeric keyboard tray.

Figure 18:
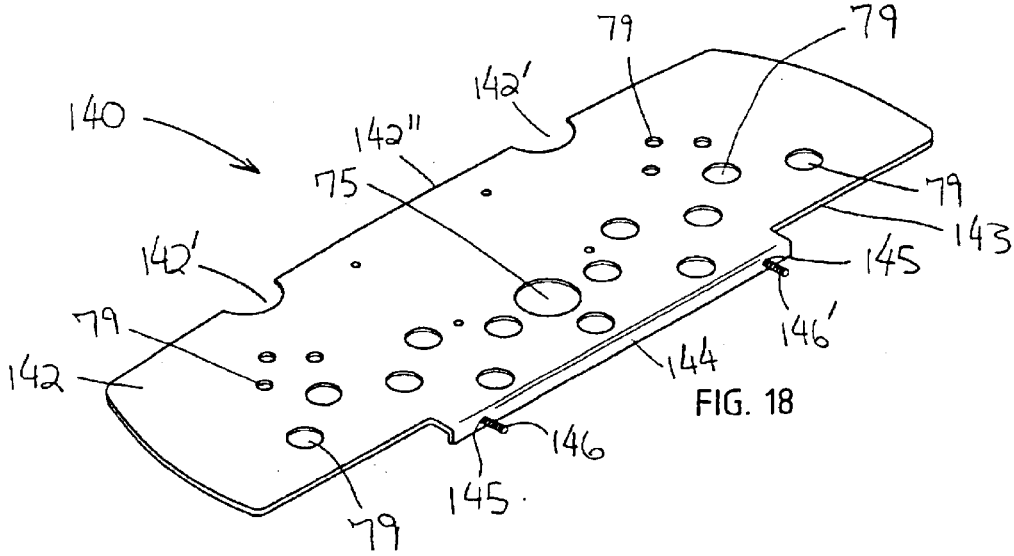
FIG. 18 is a perspective view of the support member for the keyboard tray of FIG. 17.

As shown in FIGS. 5, 16, and 18, the support member is formed with a central hole 75 and one or more off-center or flow through holes 79. When support member 70 is secured within interior 11 of injection mold 10, central hole 75 is positioned in registration with injection port 118. Placing central hole 75 of support member 70 in registration with injection port 118 permits polymeric material to flow through support member 70 and towards inner surface 115 of section 114 of injection mold 110 to thereby increase the speed at which interior 111 is filled with polymeric material. Off-center holes 79 provide additional flow through regions through which the polymer may flow, thereby reducing the time necessary to fill interior 111, and hence, reduces the time required to mold keyboard tray 10. While not wishing to bound by theory, it is believed that providing central hole 75 and off-center holes 79 in support member 70 promotes uniform density in the resultant keyboard tray 10. Off-center holes 79 may be of any size and pattern, as demonstrated by the various sizes and patterns of FIGS. 5, 16, and 18.

Figure 11:
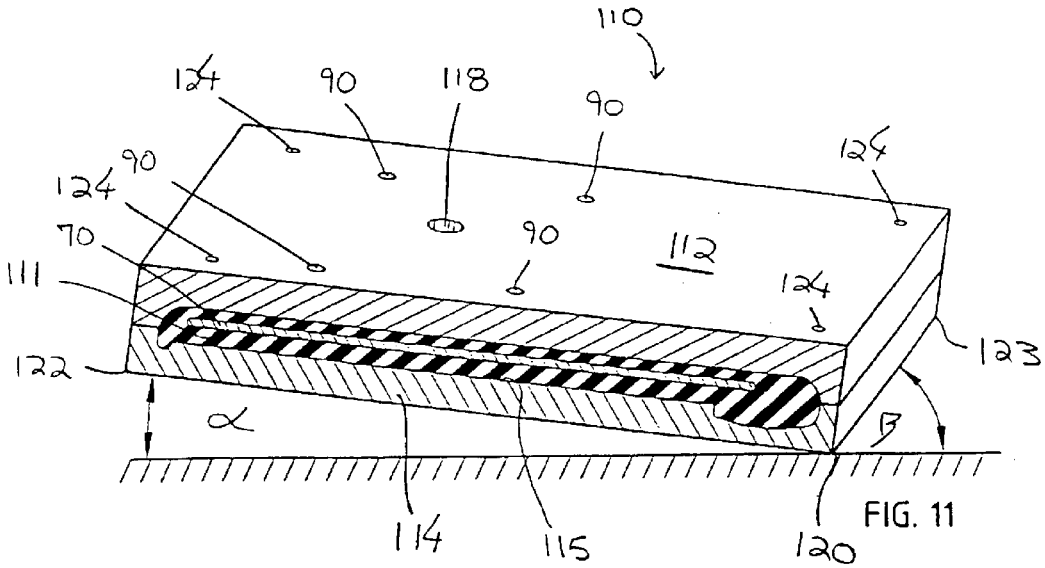
FIG. 11 is a sectional view of the injection mold of FIG. 10, tilted at a first angle and a second angle.

As shown in FIG. 11, injection mold 110 is preferably positioned at a preselected angle $\alpha$ off the horizontal such that edge 120 of section 114 is positioned in a plane below edge 122 of section 114. Tilting injection mold 10 at a preselected angle $\alpha$ off the horizontal facilitates injection of polymeric material within interior 111 by utilizing the gravitational effect. Additional, the tilt angle $\alpha$ of injection mold 110 results in the movement of air trapped within mold 110 upwards from mold section 114 to mold section 112, where it is exhausted by one or more air exhaust ports 124. As inner surface 115 of mold section 114 corresponds to top 21 of keyboard receiving member 20 and the exterior surface of wrist rest 46, tilting injection mold 110 at angle $\alpha$ results in the migration of air away from inner surface 115, and thus reduces the occurrence of surface defects in top 21 and wrist rest 46. The tilting of injection mold 110 also reduces the occurrence of density gradients as a result of trapped air within the interior of keyboard tray 10. Angle $\alpha$ is between approximately 1° and 10°, preferably between approximately 4° and 7°, and most preferably between approximately 5° and 6°.

Injection mold 110 is preferably placed at a tilted position such that mold 110 is oriented to assume angle $\alpha$, and a second tilt angle $\beta$. Angle $\beta$ is defined as the angle at which edge 123 of mold section 114 deviates from the horizontal. That is, edge 120 is positioned in a plane below edge 123. Angle $\beta$ is preferably between approximately 1° and 10°, more preferably between approximately 4° and 7°, and most preferably between approximately 5° to 6°. The tilting of mold 110 at both angle $\alpha$ and $\beta$ maximizes the evacuation of air from mold 110 during the manufacturing process of computer keyboard tray 10 and minimizes the occurrence of air pockets, increases the uniform density of the resulting keyboard 10 and decreases the occurrence of surface defects in top 21 and wrist rest 46, Also, the increased fluid pressure imparted upon section 114 is believed to result in the formation of a stronger, uniform density, wrist rest which aids in the avoidance of repetitive stress injures.

When keyboard tray 10 is formed with cable ways 60 or 60', section 112 is formed with one or more exhaust ports positioned in proximity to the molding region in which a cable way 60, 60' is formed. The presence of these exhaust ports proximate to the molding region of cable ways 60, 60' increase the quality of the mold about the region as the curvaceous surface of cable ways 60, 60' may potentially trap air, and thus reduce the uniformity of the resultant keyboard tray.

Figure 12:
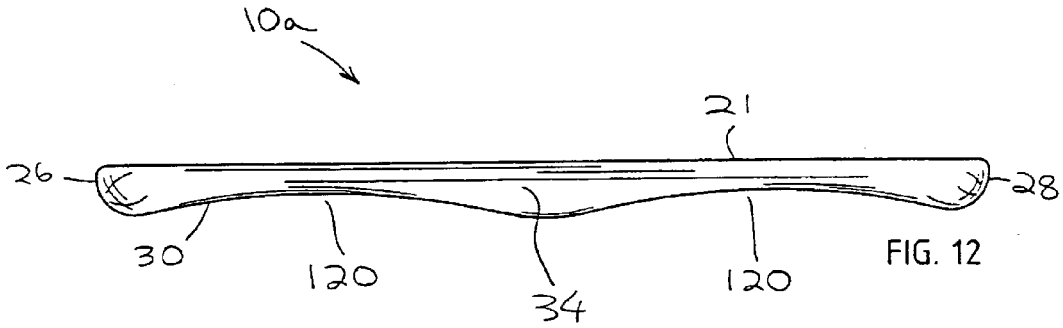
FIG. 12 is a front view of a keyboard tray according to an alternative preferred embodiment of the present invention.

Turning now to FIG. 12, according to an alternative preferred embodiment, a keyboard tray 10*a* is formed having two arcuate or concave channels 120 in bottom 30 of keyboard receiving member 20. Arcuate channels 120 extend from front 34 to back 38 of keyboard receiving member 20, and are each dimensioned to receive a thigh of a computer operator, and hence permits keyboard tray 10*a* to be supported upon one's lap. In all other aspects, keyboard tray 10*a* is structurally similar to keyboard tray 10 except for the absence of attachment assembly 80, 80'.

Figure 13:
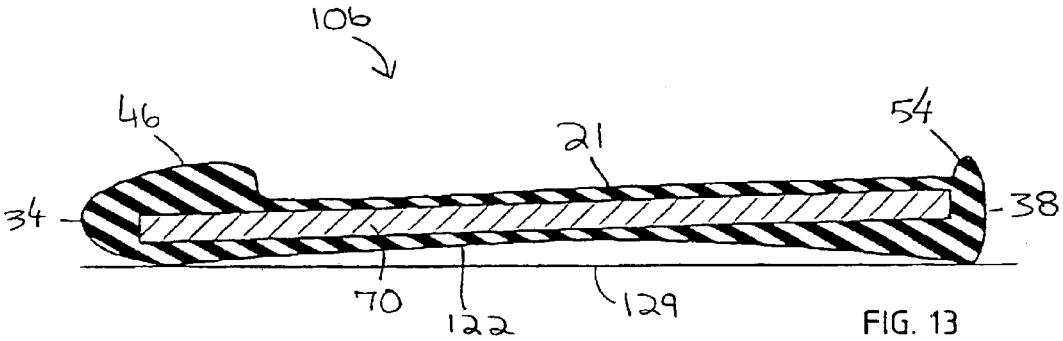
FIG. 13 is a sectional side view of a keyboard tray according to another alternative preferred embodiment.

With reference to FIG. 13, a computer keyboard 10*b* includes a contoured bottom surface 127 so that keyboard receiving member 20 is at a positive inclination from front 34 to back 38, relative to surface 129. The angulation of keyboard tray 10*b* results in the inclination of the computer keyboard at a comfortable typing angle. In all other aspects, keyboard tray 10*b* is structurally similar to computer keyboard tray 10 except for the absence of attachment assembly 80, 80'.

Referring now to FIGS. 17 through 20, in another preferred embodiment, a keyboard tray 10*c* includes a keyboard receiving member 130 having a front 132, an opposing back 134, and a pair of opposing sides 136 and 138, and is dimensioned to receive a standard or extended size keyboard 200. Keyboard receiving member 130 is formed with an attachment assembly 80 or 80' to permit attachment of keyboard receiving member 130 to computer keyboard support mechanism 134. Keyboard receiving member 130 is essentially planar while a support member 140, depicted in FIG. 18, is positioned within its interior. Support member 140 is formed with a generally planar first member 142, which is substantially parallel to top 131 of keyboard receiving member 130 when positioned within its interior, and includes a front edge 143. A pair of cutouts 142' are formed in rear surface 142" and correspond to the molding area for cable ways 60, 60'. A ledge 144 depends from front edge 143 of support member 140 and is generally orthogonal thereto. Ledge 144 includes at least one, and preferably, a pair of throughholes 145 through which fasteners 146, 146' such as, for example, bolts, are positioned.

Support member 140 is integrally molded within the interior of keyboard receiving member 130 with ledge 144 depending toward bottom 139 and in proximity to, and substantially parallel with, front 132. Fasteners 146, 146' extend through front 132 of keyboard receiving member 130 and provide securing sites for the removable attachment of an adjustable wrist rest assembly 150 to keyboard receiving member 130.

Adjustable wrist rest assembly 150 is provided with a wrist rest 151 formed of a polymeric material, preferably a foamed polymeric material, and is fixedly attached to support section 154 of an attachment member 152 by any means commonly employed in the art. Preferably, wrist rest 151 is attached to top surface 153 by an adhesive. Support section 154 is generally parallel to bottom 139. Depending from edge 154' of support section 154 is a ledge 156. Ledge 156 spans the length of support section 154 and is generally orthogonal thereto. An attachment plate 158 extends from the central section of ledge 156 and is configured to receive an attachment assembly 160. Attachment plate 158 includes a pair of generally vertical slots 162 and 164, each of which is proximate to an edge 158', 158", respectively. Positioned between slots 162, 164 are three spaced pins 165*a*, 165*b*, 165*c* projecting substantially orthogonal from surface 159 of attachment plate 158.

Attachment assembly 160 includes a pair of arms 168 and 169 and a locking member 175. Each arm 168, 169 is formed with three throughholes 172*a*, 172*b*, 172*c*, and includes two sections 174 and 176 which meet at an angle. To assemble attachment assembly 160 to attachment plate 158 of adjustable wrist rest assembly 150, attachment member 152 is placed in proximity to front 132 of keyboard receiving member 130 so that slots 162 and 164 are aligned with fasteners 146, 146' projecting from front 132. Thereafter, attachment plate 158 is moved such that fasteners 146, 146' extend through slots 162, 164. Arms 168 and 169 are then placed in position with fastener 146 extending through throughhole 172*a* of arm 168 while throughholes 172*b* and 172*c* of arm 168 receive pins 165*a* and 165*b*, respectively. Arm 169 is juxtaposed with relation to arm 168, with pin 165*b* and 165*c* extending through throughholes 172*c* and 172*b* of arm 169, respectively. Fastener 146' also extends through throughhole 170*a* of arm 169. Once arms 168 and 169 are in position, fastener 146' extending through slot 164 and arm 169 is fitted with a nut and washer assembly 173 to thereby secure arm 169 in place. Fastener 146, extending through slot 162 and arm 168, has attached at its free end locking member 175. Locking member 175 is formed with an internally threaded channel dimensioned to receive fastener 146. Once arms 168, 169 and locking member 175 are in position, a pair of spring members 177 and 178, each of which has a curved end 180, are placed about the outer periphery of pin 165*b*, with their free ends extending slightly beyond and supported by the top surface of pin 165*a* and 165*c*, respectively. After spring members 177, 178 are in position, a securing member 182 is placed over pin 165*b* to hold arms 168, 169 and spring member 177, 178 in place, while a cover 179 (FIG. 17) is placed over attachment plate 158 and attachment assembly 160 leaving only locking member 175 exposed. Cover 179 includes a side cut out 179' to permit movement of arm 168, and is adhesively attached to attachment plate 158 by applying a suitable adhesive about perimeter 179". Cover plate 179 protects a user from injury by preventing contact with the components of attachment assembly 160, and prevents unauthorized tampering therewith. Preferably, cover 179 is made of polyurethane.

To adjust adjustable wrist rest assembly 150, once it is attached to keyboard receiving member 130, handle 175' of locking member 175 is rotated in a particular direction to loosen adjustable wrist rest 150. A slight force is placed upon adjustable wrist rest assembly 150 in either the upward or downward vertical direction to alter the position of wrist rest 151 relative to top 131 of keyboard receiving member 130. Application of a vertical force on adjustable wrist rest assembly 150 moves the same along slots 162, 164, with pin 165*a* acting as a pivot point for arm 168, and pin 165*c* for arm 169. Once adjustable wrist rest assembly 150 is placed in the desired position, handle 175' of locking member 175 is rotated to secure adjustable wrist rest assembly 150 in position.

Figure 19:
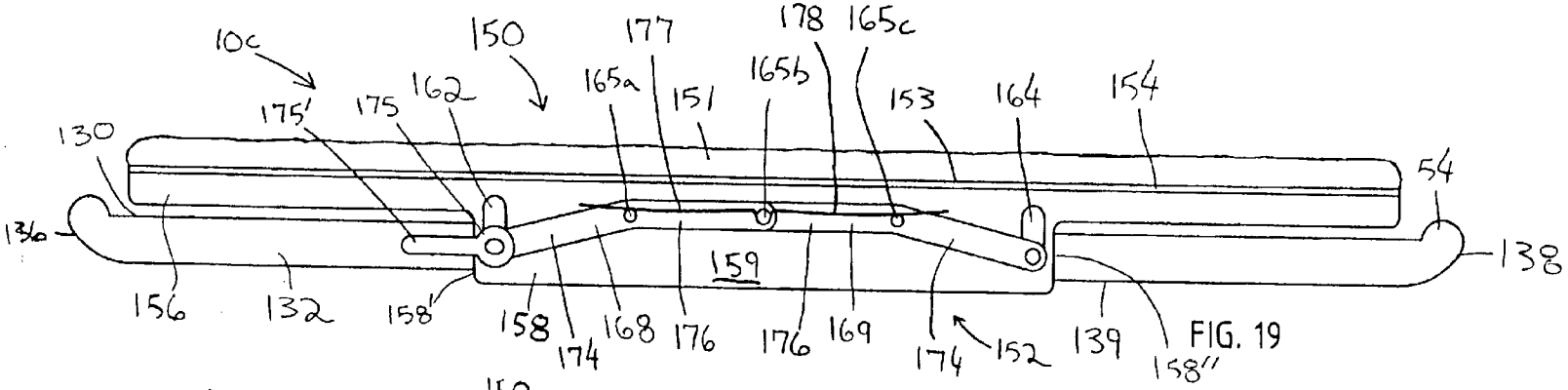
FIG. 19 is a front view of the keyboard tray of FIG. 17, with the adjustable wrist rest assembly depicted in the raised position.
Figure 20:
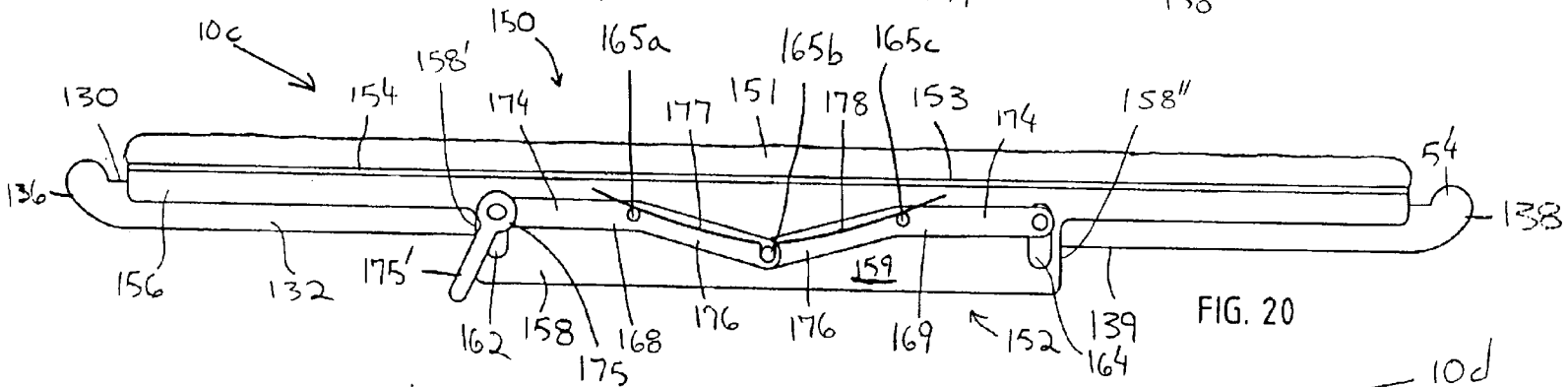
FIG. 20 is the same view as FIG. 19, with the adjustable wrist rest assembly depicted in the lowered position.
Figure 25:
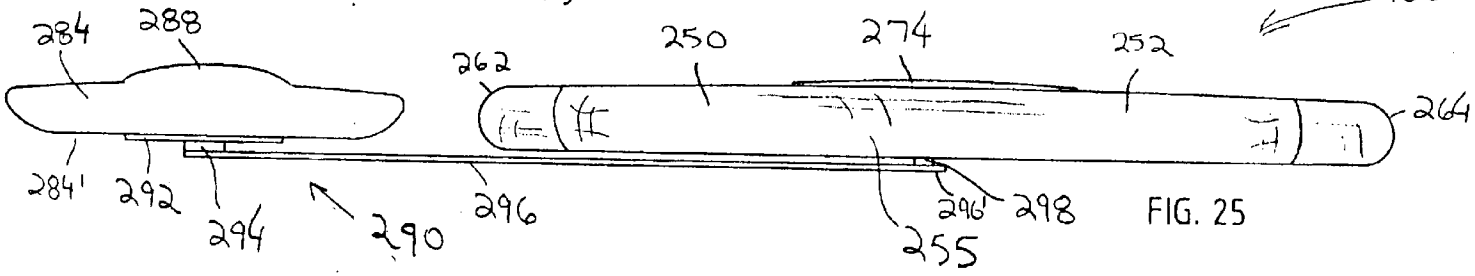
FIG. 25 is a front view of the keyboard tray of FIG. 21.
Figure 21:
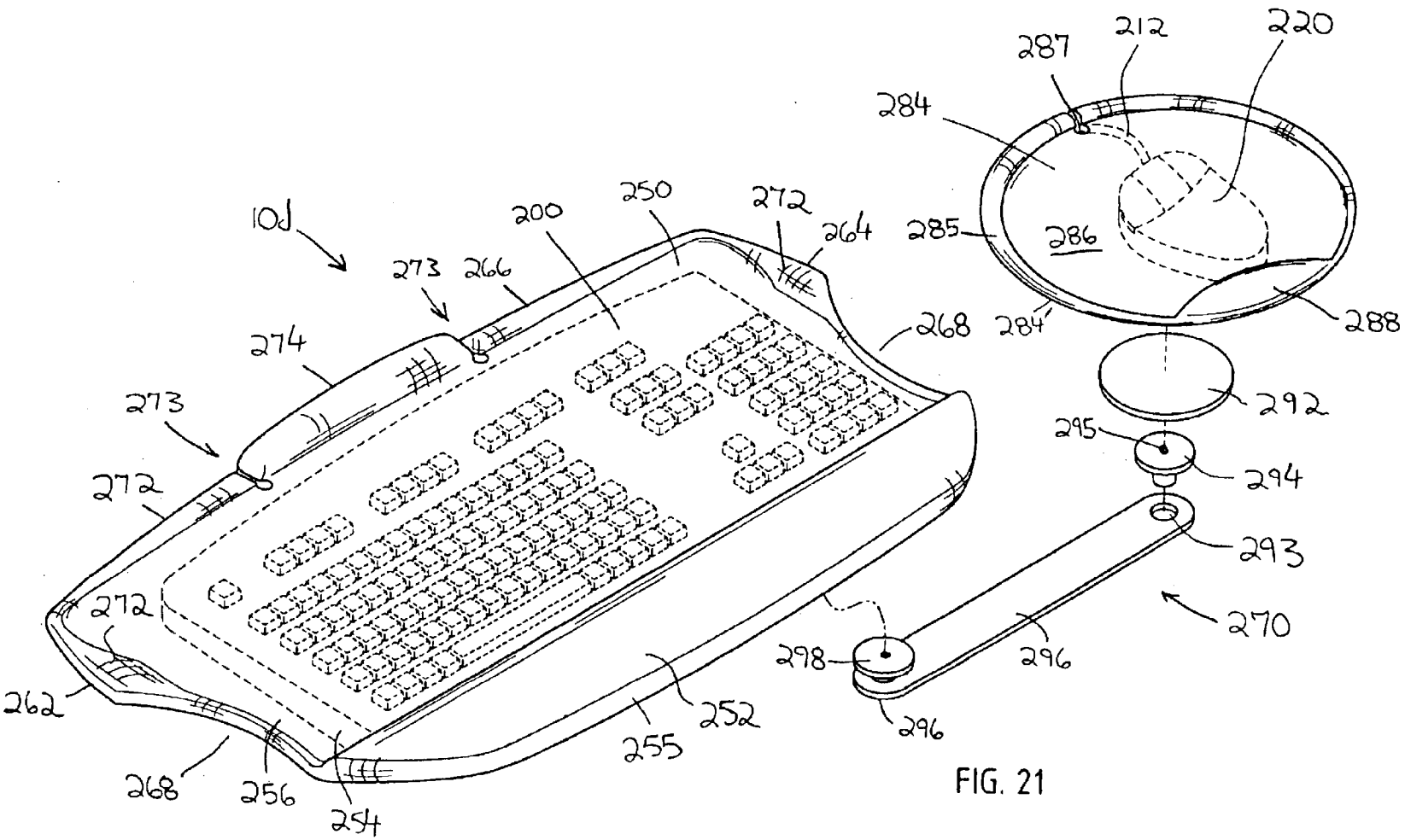
FIG. 21 is an exploded perspective view of a keyboard tray with an adjustable mouse pad assembly according to another alternative preferred embodiment.

Adjustable wrist rest assembly 150 is shown in the raised position in FIG. 20, while FIG. 19 depicts adjustable wrist rest assembly 150 in the lowered position. As adjustable wrist rest assembly 150 is moved between the raised position and the lowered position, spring members 177, 178 provide a biasing force to retard the movement of adjustable wrist rest assembly 150 as it is moved from the raised position to the lowered position. The retardation of movement of adjustable wrist rest assembly 150 prevents the damage caused by the forcible contact between the ends of slots 162, 164 and fasteners 146, 146' when adjustable wrist rest assembly 150 is moved from the raised position to the lowered position.

Figure 24:
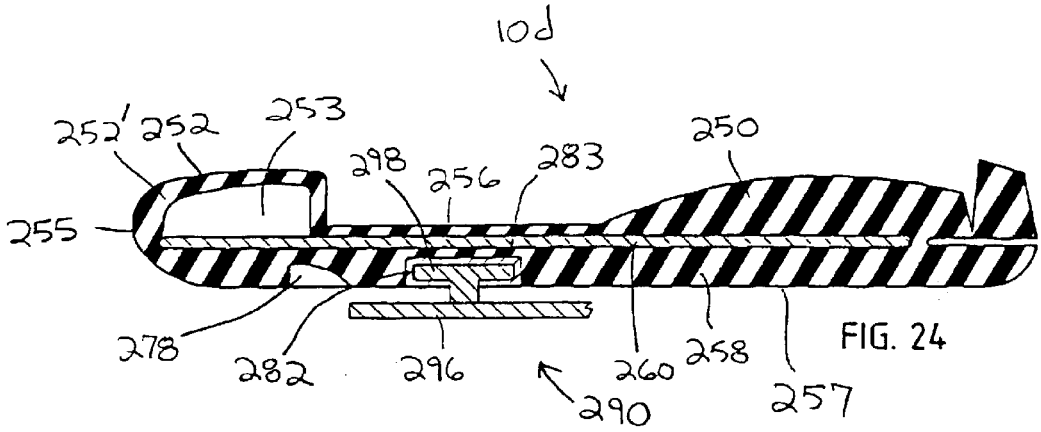
FIG. 24 is a side sectional view of the keyboard tray of FIG. 21.
Figure 26:
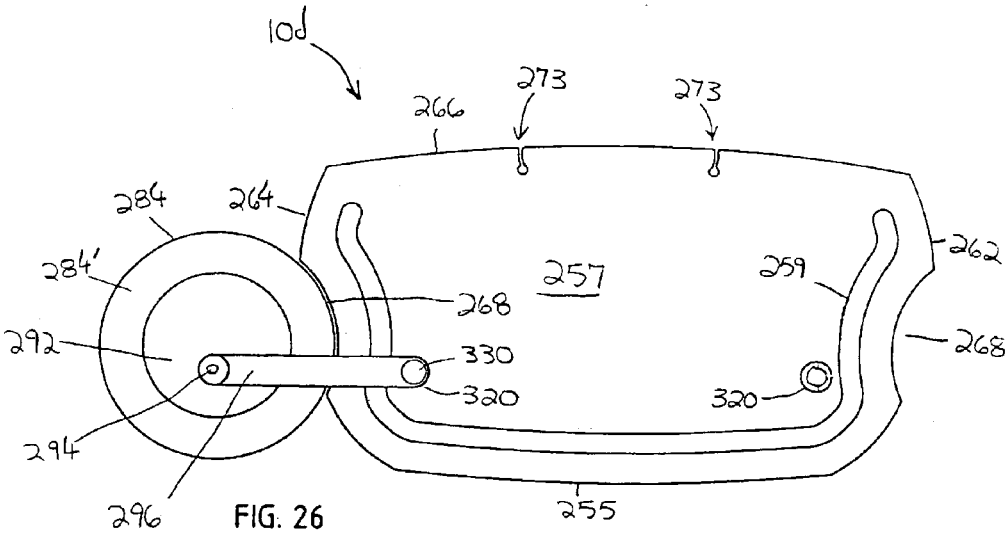
FIG. 26 is a bottom view of a keyboard tray according to still another alternative preferred embodiment.
Figure 27:
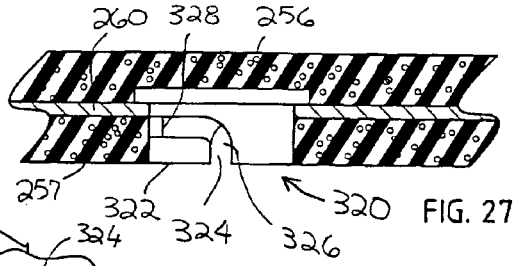
FIG. 27 is a side view of a cam member, illustrated attached to a support member and positioned within a keyboard receiving member, both depicted in cross-section.
Figure 28:
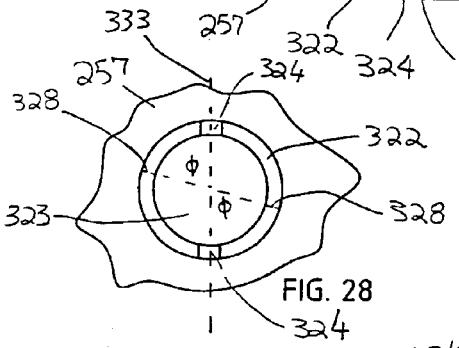
FIG. 28 is a bottom view of the cam member of FIG. 27.
Figure 30:
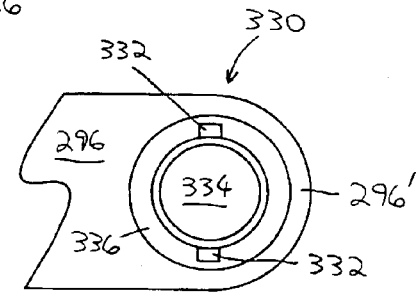
FIG. 30 is a top view of the securing member of FIG. 29.
Figure 29:
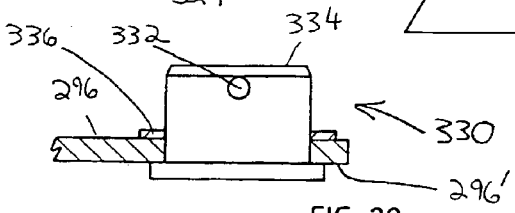
FIG. 29 is a detailed view of a securing member for the keyboard tray depicted in FIG. 26 with the friction member and arm depicted in cross-section.

With reference to FIGS. 21 through 25, a keyboard tray 10*d*, according to a preferred alternative embodiment, includes a keyboard receiving member 250 having a wrist rest 252 extending from front region 254 of top 256. Wrist rest 252 is formed having an internal channel 253 positioned within interior 252' (FIG. 24). Internal channel 253 runs generally from end-to-end of wrist rest 252 and is sealed by the polymer comprising wrist rest 252. Alternatively, wrist rest 252 may have the same solid foamed polymer construction as wrist rest 46. Positioned with interior 258 of keyboard receiving member 250 is a support member 260. Keyboard receiving member 250 includes a pair of opposing sides 262 and 264 and a back 266. Each opposing side 262, 264 has an arcuate cutout region 268. Each arcuate cutout section 268 has substantially the same angle of curvature as the mouse pad 284 of an adjustable mouse pad assembly 270. Projecting from top 256, along back 266 and opposing sides 262 and 264 is a rim 272. Seen most clearly in FIGS. 21 and 23, rim 272, extending from back 266, has a central section 274 having an increased height with respect to the adjacent sections of rim 272 along back 266. Back 266 includes a pair of cable ways 273. Each cable way 273 includes a generally keyhole shaped slot 275 similar to that depicted in FIG. 7. In addition, cable ways 273 include a horizontal slot 276 formed in back 266 and in registration with keyhole slot 275. Cable ways 273 enable a cable to be inserted within the seating end of keyhole shaped slot 275 and placed within the generally horizontal slot 276 formed in back 266 of keyboard receiving member 250.

Figure 22:
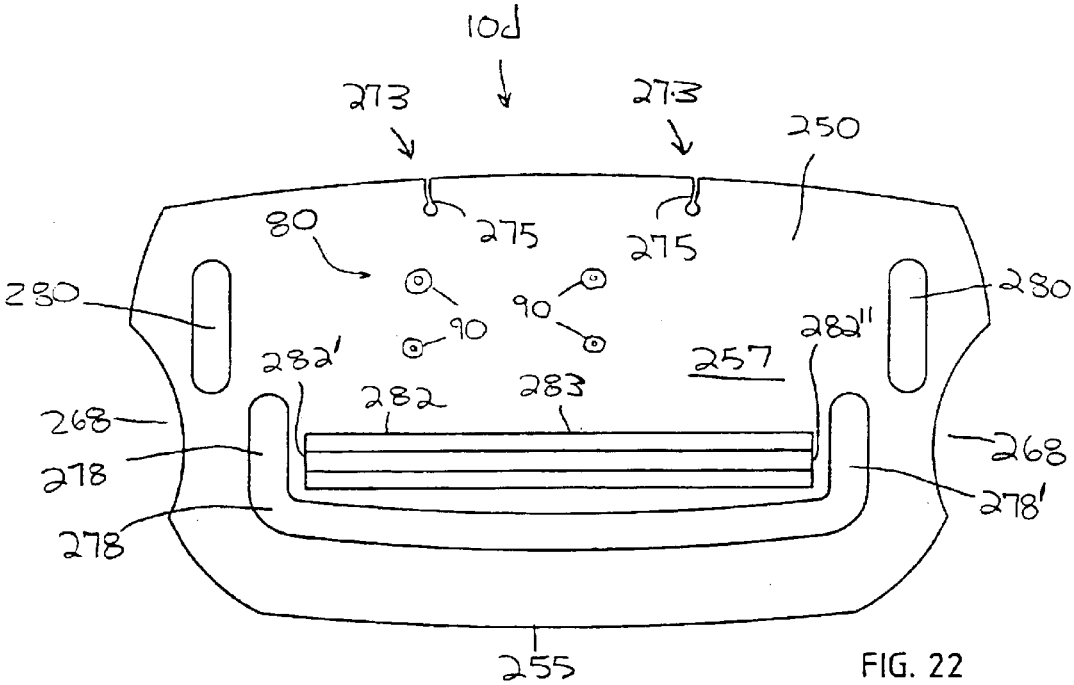
FIG. 22 is a bottom view of the keyboard receiving member of FIG. 21.
Figure 23:
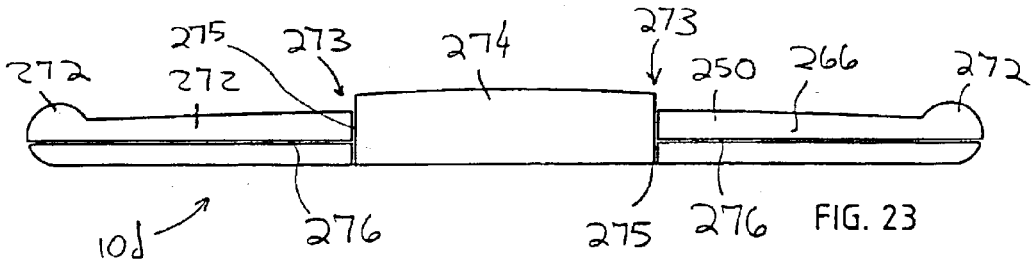
FIG. 23 is a rear view of the keyboard receiving member of FIGS. 21 and 22.

Bottom 257 of keyboard receiving member 250 includes a C-shaped grasping channel 278 positioned proximate to front 255. In addition, proximate to each side 262', 264 is a grasping channel 280, each of which is formed generally orthogonal to back 266. C-shaped grasping channel 278 and grasping channels 280 provide a variety of grasping surfaces to enable an individual to grasp the underside of keyboard receiving member 250 and move the same when used in conjunction with a computer keyboard support mechanism 134. As depicted in FIG. 22, keyboard receiving member 250 is formed with an attachment assembly 80', enabling keyboard receiving member 250 to be used in conjunction with a computer keyboard support mechanism 134. However, it will be recognized by those with ordinary skill in the art, that attachment assembly 80 may be formed in keyboard receiving member 250.

A track 282 is positioned within bottom 257 and is generally perpendicular to ends 278' of C-shaped grasping channel 280. Track 282 is generally T-shaped in cross section and is adhesively attached about its exterior surface to the wall formed by a channel or cutout 283 within bottom surface 257 (FIG. 24). Track 282 is formed of a low friction material such as, for example, a suitable polymer, metal or metal alloy.

Adjustable mouse pad assembly 270 includes a generally circular mouse pad 284 formed with a peripheral rim 285 extending from top 286, a generally keyhole slot shaped cable way 287 and a wrist rest 288. Mouse pad 284 may contain a support member within its interior similar to support member 70, or may be formed completely of a polymeric material.

Bottom 284' of pad 284 is attached to a mouse pad adjustment assembly 290. Mouse pad adjustment assembly 290 includes a plate 292 fixedly attached to bottom surface 284' of mouse pad 284, and a first pivot member 294 attached to and depending from plate 292. Pivot member 294 is secured within throughhole 293 of a generally linear arm 296. End 296' of arm 296 is secured to a second pivot member 298 which is dimensioned for receipt within track 282 of keyboard receiving member 250. Pivot members 294 and 298 may be any pivot members normally encountered in the art capable of enabling adjustable mouse pad assembly 270 to pivot about a first generally vertical pivot point 295 and a second generally vertical pivot point 299, respectively. Non-limiting examples of pivot members 294 and 298 include, but are not limited to, ball and socket assemblies and swivel joint assemblies.

In operation, adjustable mouse pad assembly 270 may be placed on the left or right side of keyboard receiving member 250 as the operator desires. This is accomplished by rotating or pivoting adjustable mouse pad assembly 270 about pivot member 298 until mouse pad 284 is positioned beyond front 255 of keyboard receiving member 250. Thereafter, the operator applies a slight horizontal force to mouse pad 284 so that pivot member 298 slides within track 282, between ends 282, 282'. Once pivot member 298 is positioned proximate to the desired side 262, 264, mouse pad 284 is again rotated about pivot member 298 to thereby rotate mouse pad 284 into abutting contact with arcuate cutout section 268 formed on side 262, or 264. Once adjustable mouse pad 284 is in position against arcuate cutout section 268, the operator may rotate mouse pad 284 about pivot member 294 to thereby adjust the position of wrist rest 288 to the desire of the operator.

In an alternative preferred embodiment, as shown in FIGS. 26 through 30, track 282 is replaced with a pair generally cylindrical of cam members 320, each of which is fixedly attached to support member 260, and project toward bottom 257 of keyboard receiving member 250, with surface 322 of each cam member 320 being generally co-planar with bottom 257. Each cam member 320 is positioned proximate to a side 262, 264 and is provided with pair of slots 324. Each slot 324 includes a vertical section 326 formed generally parallel to surface 322 and a substantially horizontal channel 328 formed generally parallel to surface 322. Each horizontal channel 328 terminates at a preselected N from the center line 333 shown in FIG. 28. Preferably angle N is approximately 15°. Also, in this embodiment, bottom 257 is provided with one generally C-shaped grasping channel 259 formed proximate to front 255 and opposing sides 262, 264. In this embodiment, adjustable mouse pad assembly 270' is similar to adjustable mouse pad assembly 270 except that pivot member 298 is replaced with a securing member 330 fixedly attached to, and extending from end 296' of arm 296. Securing member 330 is generally cylindrical and is dimensioned for receipt by central channel 323 of cam members 320. Securing member 330 includes a pair of pins 332 positioned in proximity to top 334. Pins 332 are substantially axially aligned, extend in opposite directions, and are dimensioned for receipt by slots 324. A friction member 336, such as for example, a nylon ring, is attached to the outer periphery of securing member 330. Additionally, pivot member 294 is positioned on support plate 292 such that pivot member 294 is offset with respect to the center of mouse pad 284.

In operation, when an operator seeks to position mouse pad 284 proximate to either side 262, 242, securing member 330 is placed into contact with a cam member 320 with pins 332 entering slots 324. Once pins 332 engage horizontal sections 328, a slight rotational force is applied to urge pins 332 along horizontal sections 328 until abutting contact is made with ends 328. Thereafter, an operator may rotate mouse pad 284, about pivot member 294, to alter the position of wrist rest 288. Inadvertent detachment of mouse pad 284 from keyboard receiving member 250 is prevented by friction member 336 frictionally engaging surface 322 of cam member 320 during rotation of securing member 330. Thus, friction member 336 will retard movement of pins 332 along slots 324 in the event a person or equipment accidentally contacts mouse pad 284. In addition, offsetting pivot member 294 from the center of mouse pad 284 enables an operator to rotate wrist rest 288 into the desired use position without having to rotate securing member 330 within cam member 320 and thereby accidentally disengage mouse pad 284 from keyboard receiving member 250. To disengage mouse pad assembly 270' from keyboard receiving member 250, mouse pad assembly 270' is rotated to move pins 332 toward vertical sections 326. Thereafter, mouse pad assembly 270' is pulled downward to remove pins 332 from slots 324.

Figure 31:
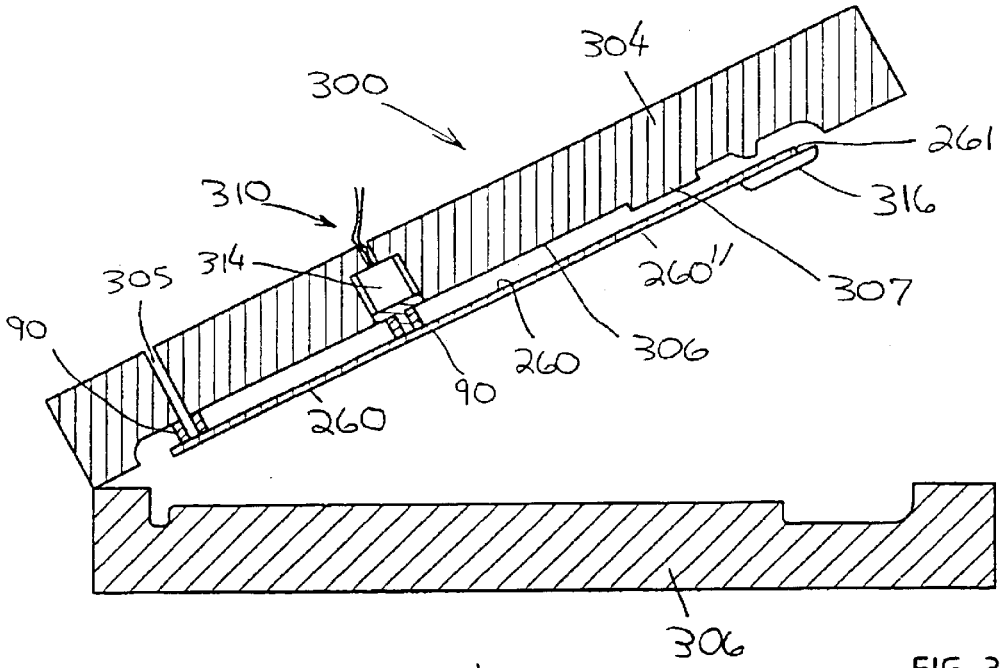
FIG. 31 is a sectional view of an injection mold for the manufacture of the keyboard tray depicted in FIGS. 21 and 26.
Figure 32:
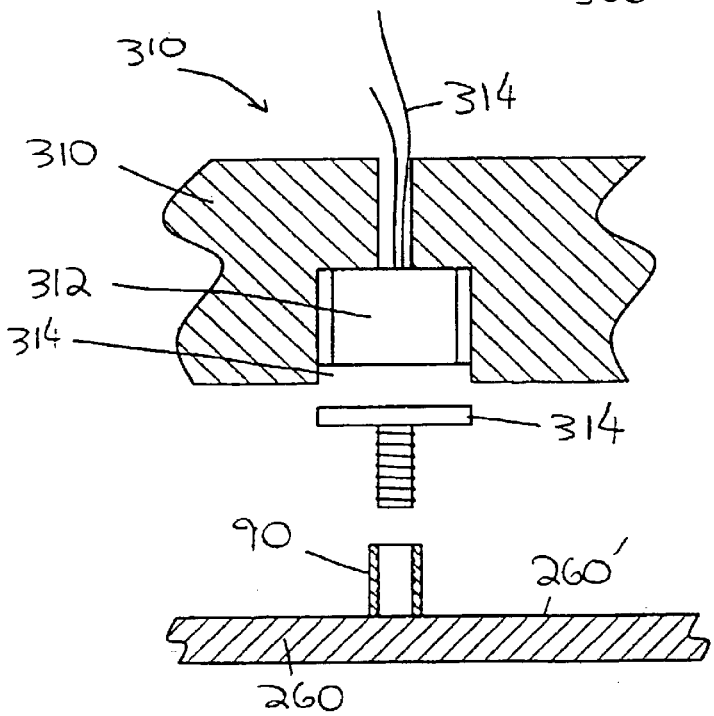
FIG. 32 is a detailed view depicting an electromagnetic attachment assembly according to the invention.

With reference to FIGS. 31 and 32, in order to manufacture keyboard receiving member 250, of keyboard tray **10*d*, support member 260 is first inserted in the injection mold 300, having at least two sections 304 and 306. To maintain support member 260 in the proper position during molding, section 302 of injection mold 300 is formed with one or more magnetic contact assemblies 310. Each magnetic contact assembly 310 includes an electromagnet 312 positioned within a channel 314 formed in section 302. Electromagnet 312 is attached to a power source (not shown) via wires 314. A threaded, magnetic contact adapter 314 is rotatably inserted within fastener receiving members 90, which are fixedly attached to surface 260' of support member 260 and form part of attachment assembly 80, 80'. Alternatively, electromagnet 312 is brought into direct contact with fastener receiving members 90, and/or cam members 320. If less than four magnetic contact assemblies 310 are used, appropriate fasteners are inserted in holes 305 of section 302 of injection mold 300 and attached to fasteners receiving members 90. Electromagnetic contact assemblies 310 provide secure support for support member 260 within injection mold 300, and reduce processing time by enabling electromagnets 312 to be de-energized to release the resultant keyboard tray 10*d*** from the injection mold subsequent to processing.

If wrist rest 252 is formed having internal channel 253, as depicted in FIG. 24, a paraffin based strip of material 316 is attached to surface 260" of support member 260, substantially parallel to front edge 261. Paraffin based strip of material 316 may be attached to surface 260' by any means commonly utilized in the art. Preferably support member 260 is preheated as discussed above so that paraffin-based strip of material 316 thermally adheres to surface 260'. Once support member 260 and strip of material 316 are in position, the processing takes place largely in conformance with the method detailed above with respect to keyboard tray 10. During the molding process, the temperature within injection mold results in the liquification of the paraffin based material and thus produces internal channel 253 within wrist rest 252. Subsequent to removal from the mold, but prior to the temperature at which the paraffin base material solidifies, a small needle is inserted within wrist rest 252 and the liquid wax material is extracted from wrist rest 252, resulting in the formation of internal channel 253. It will be understood by those with ordinary skill in the art, as detailed above, that injection mold 300 may be also tilted at an angle α and a second angle β. Also, if keyboard receiving member 250 is to be formed with a track 282, an appropriate mold section is provided within section 304, while if keyboard receiving member 250 is to be formed with cam members 320, section 304 includes a pair of molding sections. As illustrated in FIG. 31, section 304 includes a raised surface 307 projecting from interior surface 306 for the formation of cutout 283 which provides a receptacle for track 282. Any paraffin based material having a melting temperature within the processing temperatures necessary to form keyboard tray 10*d* may be used. Non-limiting examples of paraffin material suitable for use with this invention include those manufactured by Kindt-Collins Company of Cleveland, Ohio.

Figure 33:
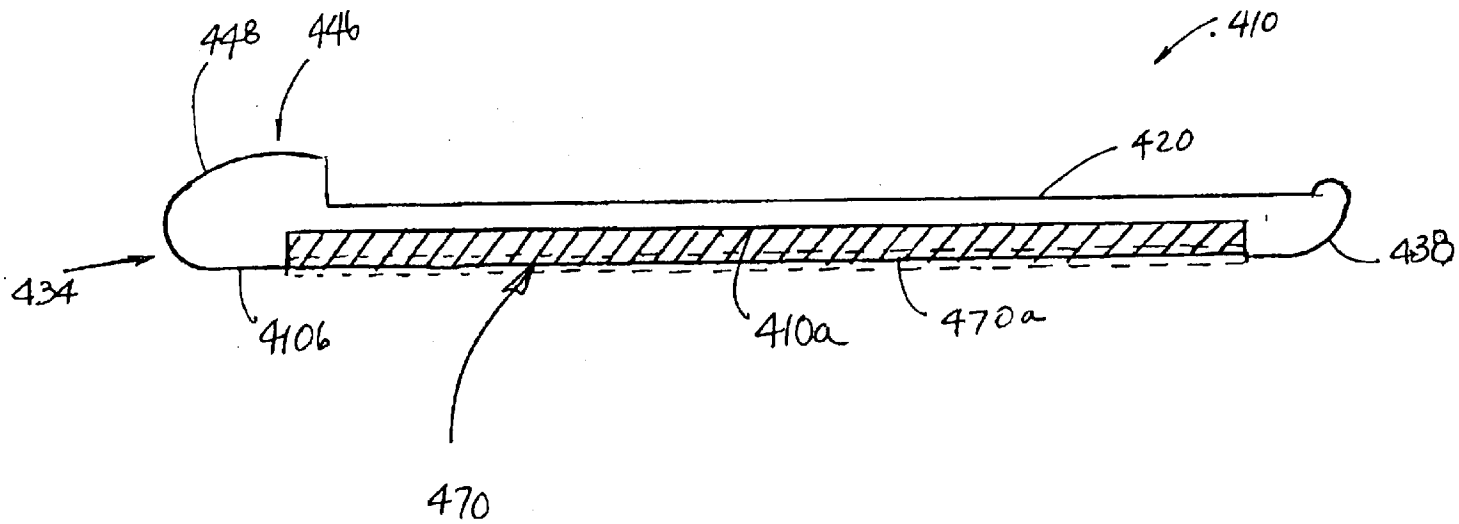
FIG. 33 is a cross-section view of yet another embodiment of the keyboard tray of the present invention.

Referring to FIG. 33, the numeral 410 generally designates another embodiment of the keyboard tray of the present invention. In the illustrated embodiment, keyboard tray 410 is of similar construction to keyboard 10 and includes a tray body with a planar upper surface that defines a keyboard receiving member 420, which is defined between a pair of opposing sides, a front 434, and a back 438, and a wrist rest 446. Keyboard receiving member 420 is dimensioned to at least support a computer keyboard. Optionally, keyboard receiving member 420 may be dimensioned to also provide a working surface for a mouse.

In the illustrated embodiment, wrist rest 446 preferably has an outwardly curved top surface 448 similar to wrist rest 46. However, it can be appreciated that wrist rest 446 may be formed having a variety of heights and widths and shapes to provide a range of ergonomically correct supports for a user's wrists. As in the case of the previous embodiments, wrist rest 446 and keyboard receiving member 420 may be monolithic, i.e., unitary in construction, and are preferably formed from a cushioning material, such as a foamed polymeric material. For further details of suitable materials for the wrist rest 446 and keyboard receiving member 420, reference is made to the previous embodiments.

Tray 410 also includes a support member 470 at least partially formed or embedded in keyboard receiving member 420. For example, support member 470 may be molded with tray 410 wherein support member 470 is integrally formed with wrist rest 446 and keyboard receiving member 420 and at least partially encapsulated in tray 410. Support member 470 is formed from a relatively rigid material to provide rigidity to tray 410 to prevent the keyboard tray from flexing, enabling the keyboard tray to support a keyboard and to be used in conjunction with computer keyboard support mechanisms commonly used in both business and home environments. Support member 470 comprises a generally flat member, which may be reinforced with ribs or the like as shown in FIG. 5, and as noted-above, may be formed or embedded in keyboard tray 410, for example, during the molding process of the tray, similar to the previous embodiments. For further details of suitable configurations of support member 470, reference is made to the previous embodiments.

Figure 34:
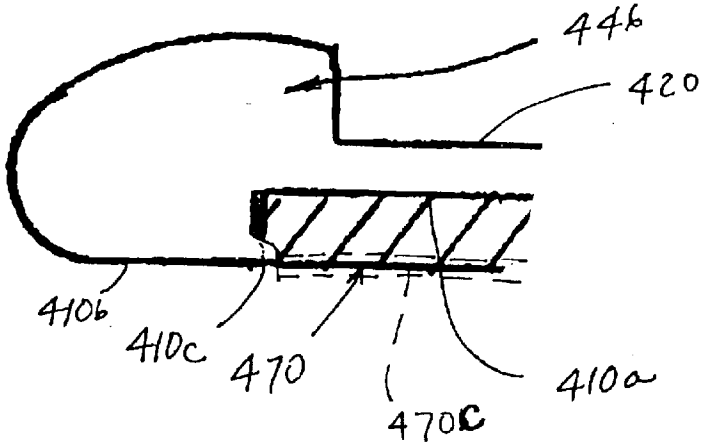
FIG. 34 is an enlarged fragmentary view of the keyboard tray of FIG. 33.

Alternately, support member 470 may be post-attached to the tray after tray 410 is molded. For example, support member 470 may be adhered to a lower surface of tray 410 using an adhesive and/or may be inserted into a recess 410*a*, which is formed in the lower or under surface 410*b* of tray 410 during molding, with a compression or friction fit and/or an adhesive. Recess 410*a* may include retaining lip 410*c* (FIG. 34) formed about the perimeter of the recess so that when support member 470 is inserted into the recess, the material forming the tray will stretch to permit support member 470 to be inserted in recess 410*a* but will at least substantially resume to its pre-inserted configuration after support member 470 is located within recess 410a with the lip compressed and generating a spring force to at least frictionally hold support member 470 in place in recess 410*a*.

It should be understood that tray 410 may be molded with other structures for retaining support member 470 in recess 410*a*. For example, recess 410*a* may include one or projecting structures or fingers with bulbous ends that cooperate with openings formed in support member 470 to releasably engage support member 470 in recess 410*a*. By providing openings that are smaller than the bulbous ends of the projecting structures or fingers, the bulbous ends will compress when inserted into the openings thus providing a friction fit between the projecting structures and the support member. Alternately, the openings may include a stepped profile with a smaller diameter portion in which the bulbous ends are compressed and a larger diameter portion where the bulbous end(s) are permitted to expand, e.g. to approximately resume their original diameter, to provide a positive interlocking of support member 470 and tray 410. In this manner, the support member may be removed for repair, replacement, or substitution with another support member that provides a different configuration so that tray 410 can be used, for example as a lap tray with one support member or a desk mounted tray with another support member.

In the illustrated embodiment, support member 470 comprises a web or plate member which has a substantially linear configuration with a generally planar lower surface 470*a*. When positioned in tray 410, support member 470 spans or extends between the sides of tray 410 and between back 438 and front 434. Though illustrated with a lower surface 470*a* that is generally flush with the lower surface 410*b* of tray 410, it should be understood that support member 470 may include at least portions that project below lower surface 410*a* or may be recessed within tray 410 in recess 410*a* (as shown in phantom in FIG. 33). Optionally, support member 470 may terminate before the sides, back 438, or front 434 so that the sides and front and back of keyboard receiving member 420 and at least a portion of wrist rest 446 are not supported on support member 470. That is—the sides, back 438, front 434 and/or wrist rest 446 may be cantilevered from support member 470. In this manner, the front and back and sides have greater flexibility than the reinforced portions of tray 410 to provide increased comfort to the user of tray 410. However, it should be understood that support member 470 may extend, such as illustrated in FIG. 13, at least partially into wrist rest 446 or may extend to front 434 to provide a mounting surface for a separately formed wrist rest, such as illustrated FIG. 17.

Examples of materials suitable for use as support member 470 include metals, such as steel, wood, and polymeric materials, or composite materials, such as metal reinforced woods or reinforced polymeric materials, or the like. Preferably, support member 470 is formed from a lightweight but substantially rigid material, such as polyurethane or a composite wood board, for example a wood board reinforced with a metal insert or backing member.

Although previously described as a web or plate member having a generally linear configuration, support member 470 may have a varying cross-section and, for example, may be molded or formed with an undulating base or lower surface (470*b*) dimensioned to receive the thighs of a computer operator, hence permitting keyboard tray 410 to be supported upon a user's lap. Furthermore, the under surface 470*a* of support member 470 may be molded or provided with a layer of a cushioning material 470*c*, such as the material forming tray 410, to provide additional comfort to the user of the tray when the tray is supported on the lap of the user. For example, support member 470 may be coated, sprayed, or dipped with the cushioning material. Alternately, the cushioning material may be molded on support member 470 using an injection molding machine and, further, may be molded during the support member forming process, such as in a two-shot molding process. Where support member 470 is formed, for example, from a metal or wood material, including a composite wood material, support member 470 may be placed in a molding machine, with the cushioning material injected into the mold cavity of the molding apparatus at least on one side of the support member. In addition, the cushioning material may be adhered to the support member 470 using an adhesive, for example in a press molding operation where the cushioning material is a preformed member that is adhered to the support member using pressure and/or heat in combination with an adhesive, which is applied to the support member before the support member is placed in the molding apparatus.

Alternately, support member 470 may include a contoured or sloped lower surface 470*d*, similar to surface 127 of the tray of the previous embodiment, so that keyboard receiving member 420 is oriented with a positive inclination from front 434 to back 438.

In addition, though described as being inserted or positioned in a recess formed on the lower or bottom surface of the tray, the recess may be located on an upper or top surface of the tray, with the support member providing at least a portion of the keyboard receiving member. In this application, the upper surface of the support member may be coated, sprayed, or dipped to provide a cushioning surface. Further, as described below, the support may extend from the upper surface of the tray to the lower surface of the tray with the cushioning material extending around the periphery of the support member.

Figure 35:
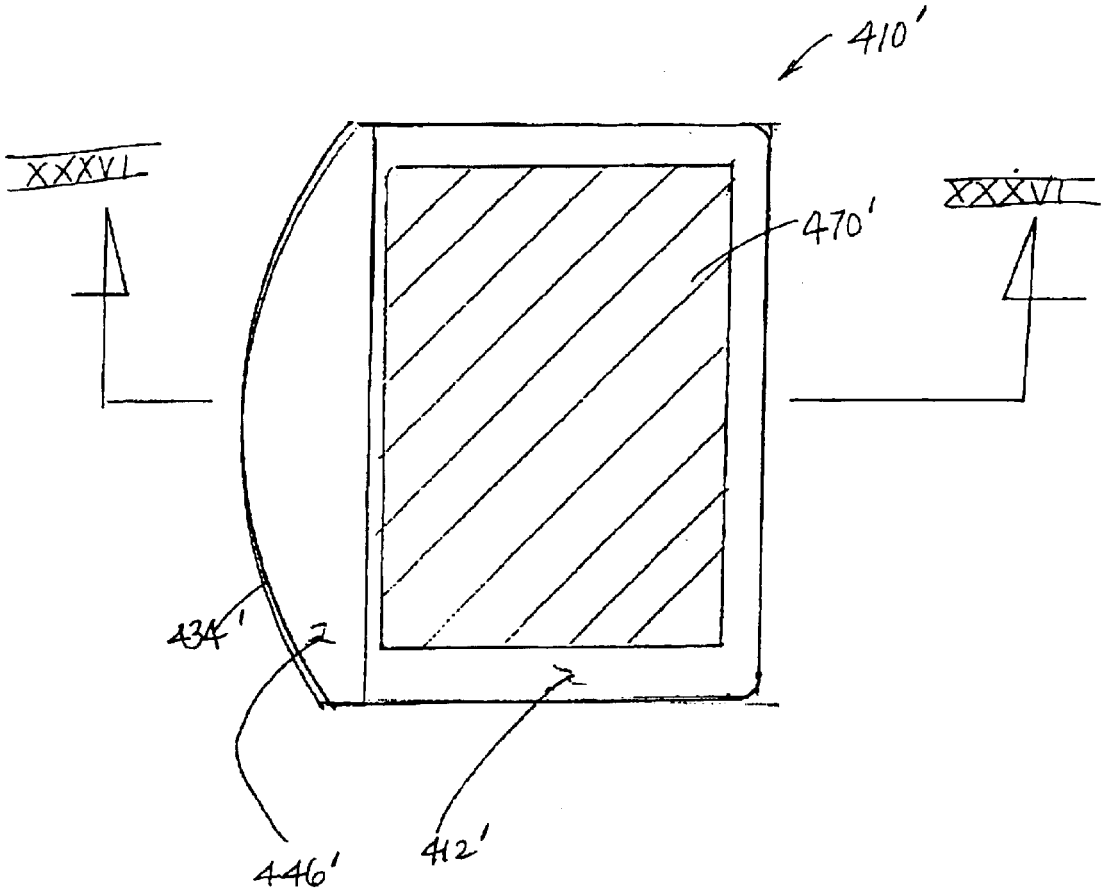
FIG. 35 is a top plan view of another embodiment of the keyboard tray of the present invention.
Figure 36:
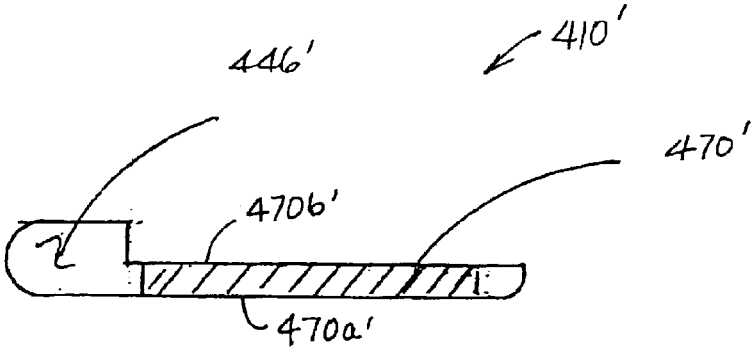
FIG. 36 is a cross-section taken along line XXXVI—XXXVI of FIG. 35.

Referring to FIGS. 35 and 36, tray 410', which is of similar construction to tray 410, may include a support member 470' that is positioned so as to present both its lower surface 470*a*' and its upper surface 470*b*' generally flush with the upper surface of the tray body 412'. However, it can be appreciated that either or both lower and upper surfaces 470*a*', 470*b*' may project above or be recessed in the respective surface of the tray. In this manner, the upper surface of support member 470' forms at least a portion of the keyboard receiving member 420'. In addition, the cushioning material extends around the periphery of the support member, with at least a portion of the front 434' enlarged to form a wrist rest 446'. Though it should be understood that a separate wrist rest may be provided. It should be understood that either upper or lower surface 470*b*' or 470*a*' of support member 470' may be coated, sprayed, dipped or otherwise provided with a cushioning surface using, for example, the cushioning material forming the tray body. Further, support member 470 may have extended portions that extend laterally into the cushioning material to provide an anchoring surface or anchoring members. For further details of optional materials for support member 470' and the tray body, reference is made to the previous embodiments. Similarly, reference is made to the previous embodiments for examples of support member configurations and additional accessories that can be mounted to tray 410'.

It should be understood that the features of each of the embodiments of the computer keyboard tray of the present invention as described may be interchanged. Also, other changes and modifications in the specifically described embodiments can be carried out without departing from the principals of the invention, which is intended to be limited only by the scope of the appended claims, as interpreted according to the principals of patent law, including the doctrine of equivalents. For example, the support member may be formed into a skeletal shape of the tray, with the cushioning material sprayed, dipped, or otherwise coated or applied onto the support member, with the support member imparting the shape to the tray.

In addition, the support member may incorporate an adjustment mechanism to provide vertical adjustment of the tray relative, for example, to the lap of a user. For example, the support member may be made from two or more members with the adjustment mechanism moving one of the members relative to the other to increase or decrease the space between the members and, thereby, raise or lower the tray.

What is claimed is:

1. A keyboard tray for use with a computer keyboard, said keyboard tray comprising:

a tray body formed from a compressible material, said body having a perimeter and a generally planar upper surface, said compressible material comprising a compressible cushioning material, said cushioning material forming said generally planar upper surface dimensioned for supporting a computer keyboard thereon and said perimeter, said cushioning material further forming perimeter sides of said tray body wherein said tray body has compressible perimeter sides to provide increased comfort to the user of the tray; and a support member positioned at least partially within said body inwardly of said perimeter sides wherein a portion of said compressible material extends around a perimeter of said support member to form said compressible perimeter sides, said support member comprising a substantially rigid material and providing reinforcement to at least a portion of said body.

2. The keyboard tray of claim 1, wherein said cushioning material forms a wrist rest.

3. The keyboard tray of claim 2, wherein said compressible cushioning material forms a rim extending at least partially around said planar upper surface.

4. The keyboard tray of claim 3, wherein said rim extends from said wrist rest.

5. The keyboard tray of claim 1, wherein said compressible cushioning material comprises a foamed polymeric material.

6. The keyboard tray of claim 1, wherein said support member is integrally molded in said tray body.

7. The keyboard tray of claim 6, wherein said support member includes a lower surface, said body having a lower surface substantially flush with said lower surface of said support member.

8. The keyboard tray of claim 1, wherein said body includes a recess, said support member positioned in said recess.

9. The keyboard tray of claim 1, further comprising an attachment assembly, said attachment assembly mounted to said support member, said attachment assembly providing attachment of said tray body to a computer keyboard support mechanism.

10. The keyboard tray of claim 1, said tray body comprising at least one throughhole formed therein for receiving at least a cable or wiring.

11. The keyboard tray of claim 1, wherein said tray includes a pair of arcuate channels, each channel of said pair of channels dimensioned to receive a thigh of an operator.

12. The keyboard tray of claim 1, wherein said tray body includes a contoured lower surface configured to incline said upper planar surface when said lower surface is supported on a generally horizontal surface.

13. The keyboard tray of claim 1, further comprising an adjustable mouse pad assembly carried by said body.

14. A keyboard tray for use with a computer keyboard and a computer keyboard support mechanism, said keyboard tray comprising:

a compressible tray body having an upper planar surface and an enlarged portion forming a wrist rest, said upper planar surface dimensioned for supporting a keyboard thereon, said compressible tray body formed from a cushioning material and having a perimeter, said compressible tray body including a support member, said support member comprising a substantially rigid web and being positioned at least partially in said compressible tray body to thereby reinforce said compressible tray body wherein said compressible tray body is capable of supporting a keyboard, and said support member positioned inwardly of said perimeter wherein said cushioning material extends around said support member to thereby form cushioned sides to provide increased comfort to the user of the tray; and an attachment assembly carried by said tray body and configured to removably mount said tray body to a computer keyboard support mechanism.

15. The keyboard tray of claim 14, wherein said attachment assembly is mounted to said support member.

16. The keyboard tray of claim 14, wherein said cushioning material comprises a foamed polymeric material.

17. The keyboard tray of claim 16, wherein said polymeric material comprises a foamed urethane.

18. The keyboard tray of claim 14, wherein said cushioning material forms a rim extending around at least a portion of said planar upper surface.

19. The keyboard tray of claim 18, wherein said rim extends from said wrist rest.

20. A method for making a keyboard tray comprising the steps of:

providing a substantially rigid support member;

applying compressible material to the support member;

forming a substantially planar support surface with the compressible material sized for supporting keyboard and forming sides of the tray with the compressible material wherein the sides of the tray are cushioned sides to increase the comfort to the user of the keyboard tray; and forming a raised portion adjacent said planar portion with the compressible material to thereby form a wrist rest wherein said planar portion and said wrist rest are monolithic.

21. The method according to claim 20, wherein said applying includes one of dipping, spraying, and coating.

22. The method according to claim 20, wherein said applying including molding.

23. The method according to claim 22, wherein said molding includes providing an injection mold having a mold cavity and supporting the support member within said mold cavity and, further, injecting the cushioning material in said mold cavity to at least partially encapsulate said support member.

24. The method of claim 23, further comprising tilting said injection mold at a first preselected angle.

25. The method of claim 24, wherein said tilting step further comprises tilting said injection mold at a second preselected angle.

26. The method of claim 24, wherein said support member is supported within said mold interior by at least one electromagnetic assembly.

* * * * *

UNITED STATES PATENT AND TRADEMARK OFFICE

CERTIFICATE OF CORRECTION

PATENT NO. : 6,903,924 B1
APPLICATION NO. : 10/205059
DATED : June 7, 2005
INVENTOR(S) : Jeff D. Tyner It is certified that error appears in the above-identified patent and that said Letters Patent is hereby corrected as shown below:

Column 5:
Line 9, "operators" should be --operator's--.

Column 8:
Line 62, "10" should be --110--.

Column 9:
Line 13, "11" should be --111--.
Line 13, "10" should be --110--.
Line 32, "10" should be --110--.
Line 67, "injures" should be --injuries--.

Column 20:
Line 8, Claim 20, Insert --a-- before "keyboard".

Signed and Sealed this

Seventeenth Day of June, 2008

JON W. DUDAS
*Director of the United States Patent and Trademark Office*